US012716422B2

(12) United States Patent
Hu et al.

(10) Patent No.: US 12,716,422 B2
(45) Date of Patent: Aug. 25, 2026

(54) PUMP UNIT FOR A CENTRIFUGAL PUMP AND CENTRIFUGAL PUMP

(71) Applicant: Levitronix GmbH, Zürich (CH)

(72) Inventors: Rennan Hu, Zürich (CH); Urs Willi, Romanshorn (CH); Alexander Schmid, Hausen am Albis (AT); Natale Barletta, Zürich (CH)

(73) Assignee: Levitronix GmbH, Zürich (CH)

( * ) Notice: Subject to any disclaimer, the term of this patent is extended or adjusted under 35 U.S.C. 154(b) by 0 days.

(21) Appl. No.: 18/806,340

(22) Filed: Aug. 15, 2024

(65) Prior Publication Data

US 2025/0075703 A1 Mar. 6, 2025

(30) Foreign Application Priority Data

Aug. 28, 2023 (EP) ..... 23193754

(51) Int. Cl.

| | |
|---|---|
| ***F04D 13/06*** | (2006.01) |
| ***F04D 1/00*** | (2006.01) |
| ***F04D 29/08*** | (2006.01) |
| ***F04D 29/12*** | (2006.01) |
| ***F04D 29/42*** | (2006.01) |

(52) U.S. Cl.

CPC ..... *F04D 29/086* (2013.01); *F04D 1/00* (2013.01); *F04D 13/06* (2013.01); *F04D 13/0626* (2013.01); *F04D 29/126* (2013.01); *F04D 29/426* (2013.01)

(58) Field of Classification Search

CPC ..... F04D 13/06; F04D 1/00; F04D 13/0606; F04D 29/086; F04D 29/628; F04D 29/426; F04D 7/06; F04D 13/0633; F04D 29/048; F04D 13/0626; F04D 29/126;

(Continued)

(56) References Cited

U.S. PATENT DOCUMENTS 5,249,942 A * 10/1993 Torii ..... F04C 2/102 418/171

5,827,262 A 10/1998 Neftel et al.

(Continued)

FOREIGN PATENT DOCUMENTS

CN 206158968 U * 5/2017
CN 210977989 U * 7/2020

(Continued)

OTHER PUBLICATIONS

European Search Report issued Feb. 12, 2024 in corresponding European Application No. 23193754.1.

*Primary Examiner* — Dominick L Plakkoottam
(74) *Attorney, Agent, or Firm* — Spencer Fane, LLP

(57) ABSTRACT

A pump unit includes a pump housing and a rotor in the pump housing. The pump unit contactless magnetic levitating and driving the rotor. The pump housing has a bottom part and a cover, the bottom part having a cylindrical cup to receive the rotor and a substantially ring-shaped first sealing surface for a sealing interaction with the cover. The cover has a substantially ring-shaped second sealing surface for a sealing interaction with the first sealing surface. One of the first and second sealing surfaces is a ribbed surface with a radial sealing rib, which extends in the circumferential direction along the entire sealing surface, while the other of the first and second sealing surfaces is a smooth surface.

17 Claims, 10 Drawing Sheets

(58) Field of Classification Search
CPC .... F04D 29/2222; A61M 60/232; H02K 5/12; H02K 7/088; F05D 2240/55
See application file for complete search history.

(56) References Cited

U.S. PATENT DOCUMENTS

| | | | | | |
|---|---|---|---|---|---|
| 5,941,536 | A * | 8/1999 | Hill | F04D 29/4286 415/173.1 |
| 6,171,078 | B1 * | 1/2001 | Schob | A61M 60/824 417/423.1 |
| 11,879,466 | B2 | 1/2024 | Stettler | |
| 2002/0000228 | A1 | 1/2002 | Schoeb | |
| 2021/0079922 | A1 * | 3/2021 | Schmid | F04D 13/026 |
| 2023/0287893 | A1 * | 9/2023 | Oniduka | F04D 13/064 |
| 2024/0369063 | A1 * | 11/2024 | Konishi | F04D 29/0413 |

FOREIGN PATENT DOCUMENTS

| | | | | | |
|---|---|---|---|---|---|
| CN | 213419450 | U | * | 6/2021 | |
| CN | 217841925 | U | * | 11/2022 | |
| CN | 119982498 | A | * | 5/2025 | |
| CN | 222924586 | U | * | 5/2025 | |
| DE | 19638722 | C1 | | 4/1998 | |
| DE | 69412492 | T2 | | 2/1999 | |
| DE | 102006034758 | B4 | * | 3/2011 | F04C 27/001 |
| DE | 102009046322 | A1 | * | 5/2011 | F04D 15/0038 |
| EP | 2082135 | B1 | * | 3/2011 | F04B 43/028 |
| EP | 4084304 | A1 | | 11/2022 | |
| JP | 2002306591 | A | * | 10/2002 | |
| JP | 4798867 | B2 | | 10/2011 | |

* cited by examiner

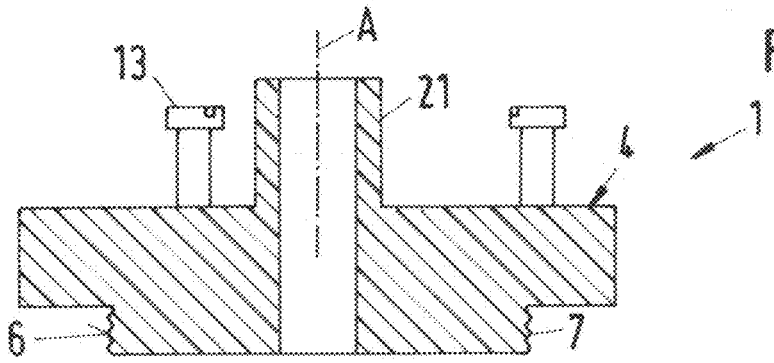
Fig.18
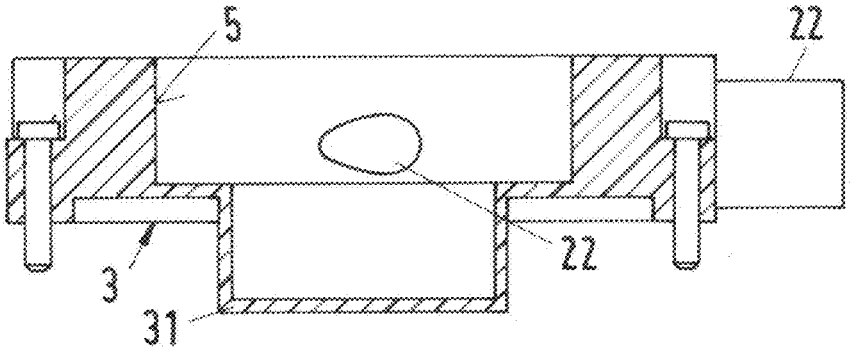
Fig.19
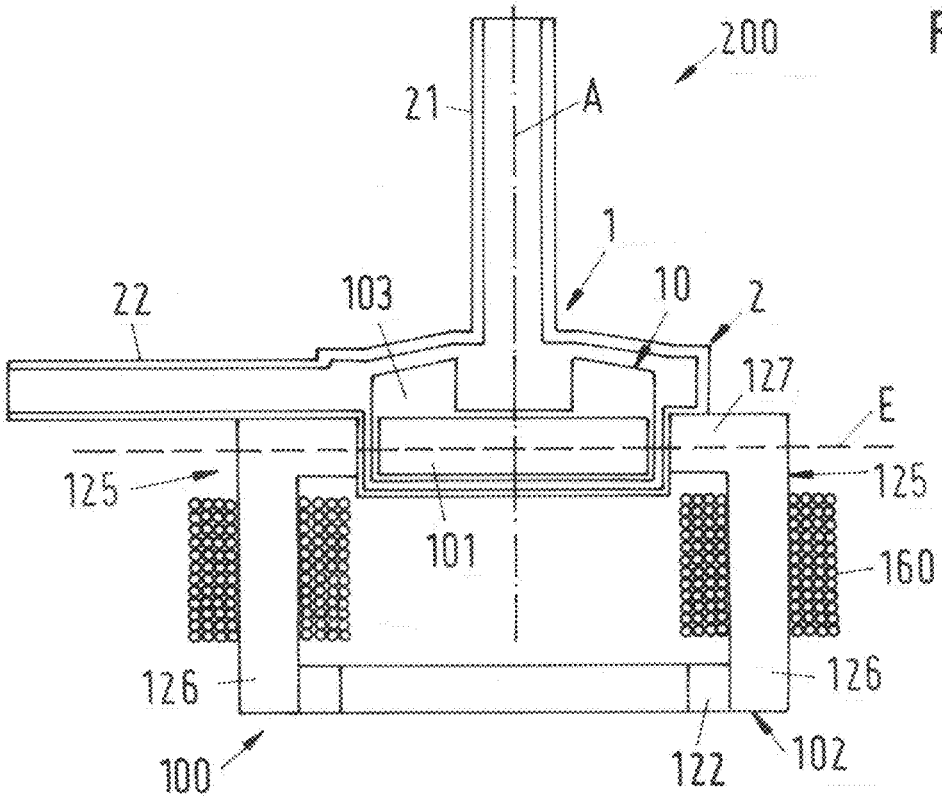

PUMP UNIT FOR A CENTRIFUGAL PUMP AND CENTRIFUGAL PUMP

CROSS-REFERENCE TO RELATED APPLICATION

This application claims priority to European Application 23193754.1, filed Aug. 28, 2023, the contents of which are hereby incorporated by reference.

BACKGROUND

Technical Field

The disclosure relates to a pump unit for a centrifugal pump for conveying a fluid. The disclosure further relates to a centrifugal pump with such a pump unit.

Background Information

Conventional centrifugal pumps can comprise a pump unit and a drive unit, wherein a rotor is provided in the pump unit, which forms the impeller of the centrifugal pump. A stator is provided in the drive unit. In the pump unit, the rotor can be magnetically supported without contact by the drive unit and can be driven without contact to rotate about an axial direction. Such centrifugal pumps are marketed, for example, by the applicant under the product name LEVITRONIX® BPS pumps.

The stator and the rotor form an electromagnetic rotary drive. In the case of LEVITRONIX® BPS pumps, for example, the electromagnetic rotary drive is designed according to the principle of the bearingless motor. The term bearingless motor refers to an electromagnetic rotary drive in which the rotor can be supported completely magnetically with respect to the stator, wherein no separate magnetic bearings are provided. For this purpose, the stator is designed as a bearing and drive stator, which is both the stator of the electric drive and the stator of the magnetic bearing. A magnetic rotating field can be generated with the electrical windings of the stator, which on the one hand exerts a torque on the rotor, which effects its rotation about a desired axis of rotation defined by the axial direction and which, on the other hand, exerts an arbitrarily adjustable transverse force on the rotor so that its radial position can be actively controlled or regulated. Thus, three degrees of freedom of the rotor can be actively regulated, namely its rotation and its radial position (two degrees of freedom). With respect to three further degrees of freedom, namely its position in the axial direction and tilting with respect to the radial plane perpendicular to the desired axis of rotation (two degrees of freedom), the rotor is passively magnetically supported or stabilized by reluctance forces, i.e., it cannot be controlled. The absence of a separate magnetic bearing with a complete magnetic bearing of the rotor is the property, which gives the bearingless motor its name. In the bearing and drive stator, the bearing function cannot be separated from the drive function.

Of course, other designs of centrifugal pumps are also known in which the rotor is magnetically supported without contact, for example those in which separate magnetic bearings are provided for the rotor so that the magnetic bearing function is separate from the drive function. For example, separate coils are provided for this purpose, with which only the bearing forces for the rotor are realized, but which do not contribute to the drive of the rotor.

Centrifugal pumps with contactless magnetically supported and driven rotors, for example those which are designed according to the principle of the bearingless motor, have proven themselves in a large number of applications. Due to the absence of mechanical bearings, such centrifugal pumps are in particular suitable for applications in which very sensitive substances are conveyed, for example blood pumps, or on which very high demands are made with respect to purity, for example in the semiconductor industry, the pharmaceutical industry, the biotechnological industry, or with which abrasive or aggressive substances are conveyed, which would very quickly destroy mechanical bearings, for example pumps for slurry, sulfuric acid, phosphoric acid or other chemicals in the semiconductor industry.

FIG. 1 shows a representation of a centrifugal pump known from the state of the art, which is designed according to the principle of the bearingless motor. For example, this is a LEVITRONIX® BPS pump. For a better understanding, a segment has been cut out in FIG. 1 so that the inside of the centrifugal pump is visible.

To indicate that the representation in FIG. 1 and FIG. 2 is a device from the state of the art, here the reference signs are each designated with an inverted comma or a dash. The centrifugal pump as a whole is designated by the reference sign 200'.

The centrifugal pump 200' comprises a drive unit 100' and a pump unit 1'. For better understanding, the pump unit 1' is shown in a sectional representation in FIG. 2, wherein the section is in the axial direction A.

A rotor 10' is arranged in the pump unit 1', which forms the wheel or the impeller with which the fluid is conveyed. The drive unit 100' comprises a motor housing 120', in which a stator 102' is arranged, which together with the rotor 10' forms an electromagnetic rotary drive for rotating the rotor about an axial direction A. The drive unit 100' is designed for contactless magnetic bearing of the rotor 10' according to the principle of the bearingless motor. For this purpose, the stator 102' is designed as a bearing and drive stator, with which the rotor 10' can be magnetically driven without contact for rotation about the axial direction A and can be magnetically supported without contact with respect to the stator 102', wherein the rotor 10' is passively magnetically stabilized with respect to the axial direction A and is actively magnetically supported in a radial plane perpendicular to the axial direction A, which plane is indicated by the line E in FIG. 1. The motor housing 120' has a recess 121' in one of its axial end faces, namely in the upper one according to the representation, into which the pump unit 1' can be inserted.

The electromagnetic rotary drive with the stator 102' and the rotor 10' is designed as a so-called temple motor. The stator 102' comprises a plurality of coil cores 125', here eight coil cores 125', each of which comprises a longitudinal leg 126', which extends from a first end, in FIG. 1 the lower end according to the representation, in the axial direction A to a second end, and a transverse leg 127', which is arranged at the second end of the longitudinal leg 126' and in the radial plane E. Each transverse leg 127' extends from the associated longitudinal leg 126' in the radial direction towards the rotor 10' and is limited by a radially inner end face. The coil cores 126' are arranged around the rotor 10' with respect to the circumferential direction, so that the rotor 10' is arranged between the radially inner end faces of the transverse legs 127' of the coil cores 126'.

All first ends of the longitudinal legs 126' are connected to each other by a back iron 122' for conducting the magnetic flux. At least one concentrated winding 160', 161' is provided at each longitudinal leg 126', which surrounds the respective longitudinal leg 126'. With respect to the number and arrangement of the concentrated windings 160', 161', many variants are known, which are not explained in more detail here. For example, there are such windings 160' which are wound around exactly one longitudinal leg 126' and such windings 161' which are arranged around exactly two longitudinal legs 126'.

The plurality of the longitudinal legs 126', which extend in the axial direction A and are reminiscent of the columns of a temple has given the temple motor its name.

The pump unit 1' comprises a pump housing 2' with an inlet 21' and with an outlet 22' for the fluid, as well as the rotor 10' arranged in the pump housing 2' for conveying the fluid, which rotor can be rotated about the axial direction A. The rotor 10' comprises a magnetically effective core 101', which interacts magnetically with the stator 102' to form the torque and to generate the magnetic bearing forces. For example, the magnetically effective core 101' is a permanent magnetic ring or a permanent magnetic disk.

Such designs are also possible in which the magnetically effective core 101' is designed in a permanent magnet-free manner, i.e., without permanent magnets. The rotor 10' is then designed, for example, as a reluctance rotor. Then, the magnetically effective core 101' of the rotor 10' is made of a soft magnetic material, for example. Suitable soft magnetic materials for the magnetically effective core 101' are, for example, ferromagnetic or ferrimagnetic materials, i.e., in particular iron, nickel-iron, cobalt-iron, silicon iron, mu-metal.

Furthermore, designs are possible in which the magnetically effective core 101' of the rotor 10' comprises both ferromagnetic materials and permanent magnetic materials. For example, permanent magnets can be placed or inserted into a ferromagnetic base body. Such designs are advantageous, for example, if one wishes to reduce the costs of large rotors by saving permanent magnetic material.

Typically, the magnetically effective core 101' is completely enclosed by a plastic. In other designs, the magnetically effective core 101' is completely enclosed in a sheath which is made of a ceramic material or of a metallic material, for example stainless steel or titanium or tantalum.

Furthermore, the rotor 10' comprises a plurality of vanes 103' for conveying the fluid from the inlet 21' to the outlet 22'.

The pump housing 2' comprises a bottom part 3' and a cover 4' for closing the bottom part 3', wherein a sealing element 90' is disposed between the bottom part 3' and the cover 4', for example an O-ring or a flat seal to prevent leakage of the fluid into the environment.

The bottom part 3' of the pump housing 2' has a cylindrical cup 31' for receiving the rotor 10'. The cup 31' is inserted into the recess 121' in the motor housing 120' so that the rotor 10', more precisely the magnetically effective core 101' of the rotor 10', is arranged between the transverse legs 127' of the coil cores 126'.

The pump unit 1' is attached to the motor housing 120', for example by a plurality of screws 11'.

For many applications, for example for applications in the semiconductor industry, the pump unit 1'—with the exception of the magnetically effective core 101'—is made of a plastic, for example a perfluoroalkoxy polymer (PFA) or polytetrafluoroethylene (PTFE), because these are plastics with a particularly high chemical resistance. These plastics are practically inert substances that cannot be attacked even by chemically very aggressive substances, such as those frequently used in the semiconductor industry. In addition, PFA and PTFE are very pure plastics because they usually have no additional substances and their molecular complexes are at least approximately inert. PFA is often preferred because it can be processed in injection molding processes.

The sealing element 90' for sealing between the bottom part 3' and the cover 4' is designed, for example, as an O-ring or as a ring-shaped flat seal. Elastomers are preferred for the sealing element 90', in particular also because elastomers have very good restoring forces. In the semiconductor industry, where extremely high demands are placed on purity, it is also common to use perfluoroelastomers (perfluoroelastomer, FFPM) for the sealing element 90'. FFPM is used in particular where a very good thermal and/or chemical resistance is necessary.

SUMMARY

In spite of these very modern and high-performance materials, it has been discovered that problems with leakage can occur, for example in the semiconductor industry. In particular at high temperatures, the chemical resistance of the elastomers can be insufficient to ensure a continuous, safe operation of the centrifugal pump. In the semiconductor industry, for example, there are processes in which sulphuric acid must be conveyed at temperatures of up to 220° C.

It has been discovered that the problem of outgassing, for example of additives in the sealing elements. In semiconductor industry, for example, the smallest impurities can have fatal consequences, as the products manufactured can be made unusable by minimal contamination. Here, it should be noted that the semiconductor industry can generate structures in the range of five nanometers or even smaller. Purity is therefore of vital importance in the semiconductor industry.

Furthermore, creep of the sealing element or parts of the sealing element can lead to problems, for example because cracks or other damage can occur in the sealing element due to the creep processes.

Particularly at higher temperatures and/or in the case of cyclical processes with frequent pressure or temperature changes, there is a risk of leakage in which very dangerous, aggressive, or harmful fluids can escape into the environment of the centrifugal pump.

Starting from this state of the art, it is therefore an object of the disclosure to propose a pump unit with a rotor that can be magnetically levitated without contact for a centrifugal pump, which has an increased operational reliability, in particular with regard to leakage, and with regard to purity. In addition, it is an object of the disclosure to propose a centrifugal pump with such a pump unit.

The subject matter of the disclosure meeting this object is characterized by the features described herein.

According to the disclosure, a pump unit for a centrifugal pump for conveying a fluid is thus proposed, comprising a pump housing with an inlet and with an outlet for the fluid, and a rotor arranged in the pump housing for conveying the fluid, which rotor can be rotated about an axial direction, wherein the pump unit is designed for a contactless magnetic levitation of the rotor and for a contactless magnetic drive of the rotor, wherein the pump housing has a bottom part and a cover for closing the bottom part, wherein the bottom part has a cylindrical cup for receiving the rotor and a substantially ring-shaped first sealing surface for sealing interaction with the cover, and wherein the cover has a substantially ring-shaped second sealing surface which is designed for sealing interaction with the first sealing surface. One of the two sealing surfaces is designed as a ribbed surface with at least one radial sealing rib, which extends in the circumferential direction along the entire sealing surface, while the other of the two sealing surfaces is designed as a smooth surface.

Due to this embodiment, it is possible to dispense with a separate sealing element between the bottom part and the cover, which would come into contact with the fluid during normal, i.e. trouble-free, operation. In normal, i.e. trouble-free, operation, the fluid to be conveyed therefore does not come into contact with any separate sealing element, so that there is no risk of the fluid being contaminated by such a separate sealing element. By dispensing with such a separate sealing element 90' (FIG. 2), all those problems caused by this separate sealing element 90' in the known pump units 1' are solved.

The dispensing with such a separate sealing element is a significant improvement in terms of the purity of the fluid to be conveyed. Since the fluid cannot come into contact with such a separate sealing element during normal operation, there is also no risk that the fluid is contaminated by such a separate sealing element, for example due to the leakage of additional substances from the sealing element, as can occur with elastomer seals, for example.

Preferably, a radial reinforcing element is provided, which is designed in a ring-shaped manner and extends radially outwards around the two sealing surfaces. The radial reinforcing element, which surrounds the two sealing surfaces radially outwards, stabilizes the first and the second sealing surface and is therefore advantageous in terms of preventing deformation of the scaling surfaces or relative movements of the two sealing surfaces to each other. In this way, it is ensured to an even greater extent that no gaps or other leakage paths open up between the two sealing surfaces, even at higher pressure in the pump housing. In addition, the radial reinforcing element is advantageous for further reducing or even completely preventing creep of the bottom part or the cover, especially if the pump housing is made of a plastic that tends to creep, such as PFA or PTFE.

Preferably, several sealing ribs are disposed in the first or second sealing surface designed as a ribbed surface, each of which extends completely along the entire circumference of the ribbed surface. Each of these sealing ribs rests against the second or first sealing surface, which is designed as a smooth surface. This means that each sealing rib is in direct physical contact with the sealing surface designed as a smooth surface. The term "smooth surface" means in particular that this sealing surface has no grooves or other recesses in which the sealing ribs can engage. Therefore, the sealing ribs rest on this unstructured smooth surface.

Embodiments are possible in which the first sealing surface is designed as the ribbed surface and the second sealing surface is designed as the smooth surface, i.e. the sealing ribs are then provided at the bottom part, and the second sealing surface, i.e. that of the cover, is unstructured designed as a smooth sealing surface.

Furthermore, embodiments are possible in which the second sealing surface is designed as the ribbed surface and the first sealing surface as the smooth surface, i.e. the sealing ribs are then provided at the cover, and the first sealing surface, i.e. that of the bottom part, is unstructured designed as a smooth sealing surface.

The term "radial scaling rib" means that the sealing rib has an extension in the radial direction perpendicular to the axial direction. As a result, the sealing ribs can absorb radial forces. It is not necessary, but possible, that the sealing ribs extend perpendicular to the axial direction. They can also extend obliquely to the axial direction.

In a preferred embodiment, each sealing rib is designed in each case in a circular shape, i.e. as a circular ring that extends in the circumferential direction along the entire scaling surface. This embodiment is preferred, but not necessary. Such embodiments in which each sealing rib is designed in an oval or spiral manner, for example, are also possible. The spiral embodiment is particularly advantageous for such pump units in which the pump housing is designed as a volute.

Particularly preferably, each sealing rib is designed in each case as a closed sealing rib, which means that the sealing rib has no beginning and no end. For example, each sealing rib is designed as a closed ring that has no beginning and no end with respect to the circumferential direction.

The bottom part and the cover are connected to each other via a press fit, which is realized by pressing each sealing rib of the first or second sealing surface designed as a ribbed surface against the second or first sealing surface designed as a smooth surface, whereby the sealing connection between the bottom part and the cover is created. Assembly of the cover and the bottom part is achieved by moving the cover and the bottom part relative to each other in the axial direction so that the first sealing surface and the second sealing surface are pressed against each other so that they interact in a sealing manner. One advantage here is that the installation direction in which the cover and the bottom part are assembled is the axial direction and the sealing ribs extend in the radial direction, i.e. perpendicular to the installation direction, and not in the installation direction.

Preferably, the ribbed surface comprises several radial sealing ribs, for example three sealing ribs, each of which extends in the circumferential direction along the entire ribbed surface, wherein the sealing ribs are arranged adjacent to one another with respect to the axial direction and a valley is disposed in each case between two adjacent sealing ribs, wherein each valley has a radial distance different from zero from the smooth surface and wherein each scaling rib has a height measured in the radial direction which is greater than the radial distance of the valley from the smooth surface. Due to this embodiment, a particularly good sealing effect between the bottom part and the cover can be realized.

It is a preferred measure that the radial reinforcing element engages both in the cover and in the bottom part. In this way, the radial reinforcing element can reinforce both the cover and the bottom part, whereby undesired relative movements between the bottom part and the cover, for example due to deformation or also creep effects, can be further reduced.

It is a further preferred embodiment that the smooth surface is designed in a frustoconical-shaped manner. For example, if the first sealing surface is designed as the smooth surface, it can be designed in a frustoconical-shaped manner in such a way that it tapers when viewed in the installation direction. With a corresponding embodiment of the second scaling surface, the thickness of the press fit between the bottom part and the cover can then be adjusted by the depth to which the cover is pushed into the first sealing surface with respect to the axial direction. It is also possible to readjust the press fit after a longer period of operation. In this way, long-term creep effects can be compensated, for example. Furthermore, it is easier and more material-friendly to separate the cover from the bottom part again, for example for maintenance work.

Furthermore, it is preferred that a ring-shaped safety seal is arranged with respect to the radial direction between the two sealing surfaces on the one hand and the radial reinforcing element on the other hand, which safety seal prevents an escape of the fluid between the bottom part and the cover in the event of a fault. During normal, i.e. trouble-free, operation of the pump unit, this safety seal does not come into contact with the fluid and also has no sealing function. However, if a fault or a significant malfunction should occur, so that the sealing effect between the first and second sealing surfaces is no longer sufficiently guaranteed, this safety seal can effectively prevent contamination of the fluid and an escape of the fluid. For example, in the semiconductor industry, such faults could have catastrophic consequences because they can lead to material rejects, e.g. wafers, which can cause very high costs. Furthermore, the escape of the fluid, for example in the case of aggressive chemicals, can lead to a significant danger for the environment.

However, the safety seal can also be placed in other locations, for example radially outwards with respect to the radial reinforcing element. In embodiments with the safety seal, it is only important that the safety seal cannot come into contact with the fluid to be conveyed during normal, i.e. trouble-free, operation.

For some applications, it is advantageous that an axial reinforcing element is disposed on the cover to absorb forces acting in the axial direction, wherein the axial reinforcing element is arranged in such a way that the cover is located between the axial reinforcing element and the bottom part with respect to the axial direction.

Preferably, a support structure is then provided which can be connected to the axial reinforcing element and which is arranged in such a way that the pump housing can be clamped between the axial reinforcing element and the support structure with respect to the axial direction. Preferably, the support structure is made of a metallic material so that it has a high stability. The support structure can, for example, be designed as a metallic mounting ring, which is arranged around the cylindrical cup of the bottom part, and which can be firmly connected to the axial reinforcing element, for example by screws.

In a preferred embodiment, a motor housing of the centrifugal pump forms the support structure, and the axial reinforcing element is designed to be attached to the motor housing of the centrifugal pump. For example, the axial reinforcing element is attached to the motor housing by screws, so that the pump housing is clamped between the axial reinforcing element and the motor housing.

The axial reinforcing element is advantageous, for example, if a high pressure is to be generated with the pump unit, or if a fluid is to be conveyed at a high temperature, or in the case of larger pump units to generate large flow rates and/or large suction heads. The axial reinforcement element offers the pump unit a greater stability, allowing it to counteract creep effects in particular, which can be caused by axial forces.

The axial reinforcing element preferably comprises a metallic base body, which is made of stainless steel, for example, and a sheath made of plastic with which the base body is encapsulated.

The axial reinforcing element can also be designed with a spring effect, for example by spring washers. In this way, a readjustment of the sealing forces between the first and second sealing surfaces is possible.

If the pump unit is designed with the axial reinforcing element, it is an advantageous measure from a constructional point of view that the axial reinforcing element is designed in one piece with the radial reinforcing element.

According to a further preferred embodiment, the bottom part comprises a ring-shaped groove which is limited by a radial inner wall and by a radial outer wall, wherein the cover is designed for sealing engagement in the groove, and wherein the radial inner wall or the radial outer wall forms the first sealing surface.

It is a further preferred embodiment that a ring-shaped recess is disposed in the cover, which recess extends radially inwards and adjacent to the second sealing surface, wherein the ring-shaped groove is separated from the second sealing surface by a ring-shaped web, so that in the operating state the pressure of the fluid on the web reinforces the sealing interaction of the first sealing surface and the second sealing surface. Due to this embodiment, the pressure of the fluid in the pump housing is used in the operating state to generate an additional force directed radially outwards, which can increase the sealing effect between the two sealing surfaces.

As already mentioned, such embodiments are possible in which the first sealing surface is designed as the smooth sealing surface and the second sealing surface is designed as the ribbed surface.

Of course, embodiments in which the first sealing surface is designed as the ribbed surface are also possible.

Preferably, the radial reinforcing element is designed as a metallic ring which is encapsulated with a coating of a plastic. Particularly preferably, the metallic ring is made of a rustproof steel or a stainless steel.

It is a particularly preferred embodiment that the outlet for the fluid is arranged in the bottom part of the pump housing. This means that the fluid is preferably discharged from the bottom part of the pump housing.

Furthermore, a centrifugal pump for conveying a fluid is proposed by the disclosure, with a pump unit designed according to the disclosure, and with a drive unit which comprises a motor housing in which a stator is arranged which, together with the rotor, forms an electromagnetic rotary drive for rotating the rotor about the axial direction, wherein the drive unit is designed for contactless magnetic levitation of the rotor.

Preferably, the stator is designed as a bearing and drive stator, with which the rotor can be magnetically driven without contact and can be magnetically levitated without contact with respect to the stator, wherein the rotor is passively magnetically stabilized with respect to the axial direction and is actively magnetically levitated in a radial plane perpendicular to the axial direction, wherein the motor housing has a recess in an axial end face, into which the cylindrical cup of the pump housing can be inserted.

Particularly preferably, the electromagnetic rotary drive is designed as a temple motor, wherein the stator has a plurality of coil cores, each of which comprising a longitudinal leg which extends from a first end in the axial direction to a second end, and a transverse leg which is arranged at the second end of the longitudinal leg and in the radial plane, and which extends from the longitudinal leg in a radial direction, wherein the coil cores are arranged around the rotor with respect to the circumferential direction, so that the rotor is arranged between the transverse legs of the coil cores, and wherein at least one concentrated winding is provided at each longitudinal leg, which winding surrounds the respective longitudinal leg.

Further advantageous measures and embodiments of the disclosure are apparent from the dependent claims.

BRIEF DESCRIPTION OF THE DRAWINGS

The disclosure will be explained in more detail with reference to the drawings.

FIG. 18 illustrates as FIG. 17, but in an exploded view, and FIG. 19 illustrates a schematic sectional representation of an embodiment of a centrifugal pump according to the disclosure.

DETAILED DESCRIPTION

Figure 1:
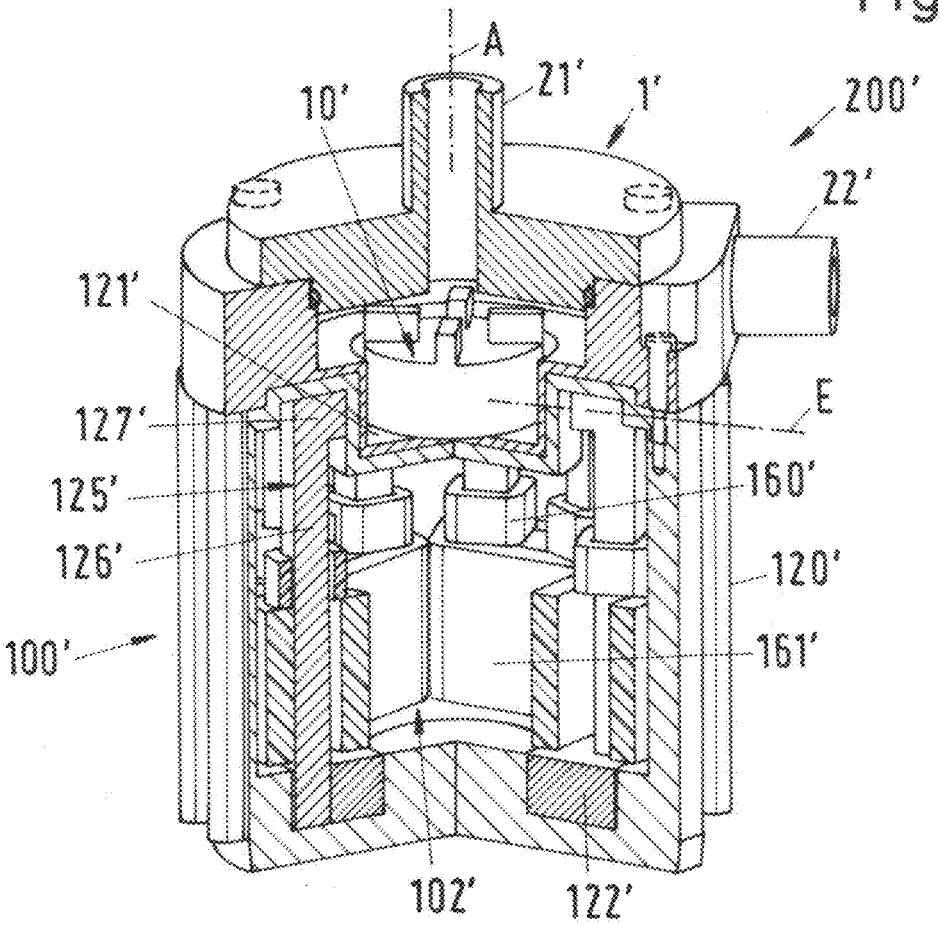
Fig.1 (Prior Art)
FIG. 1 illustrates a perspective representation of a centrifugal pump according to the state of the art, partly in section.

As already explained above, FIG. 1 shows a centrifugal pump 200' with a contactlessly magnetically supported and contactlessly magnetically driven rotor 10', which is known from the state of the art. In a sectional representation, FIG. 2 shows the pump unit 1' of this centrifugal pump 200'.

Figure 2:
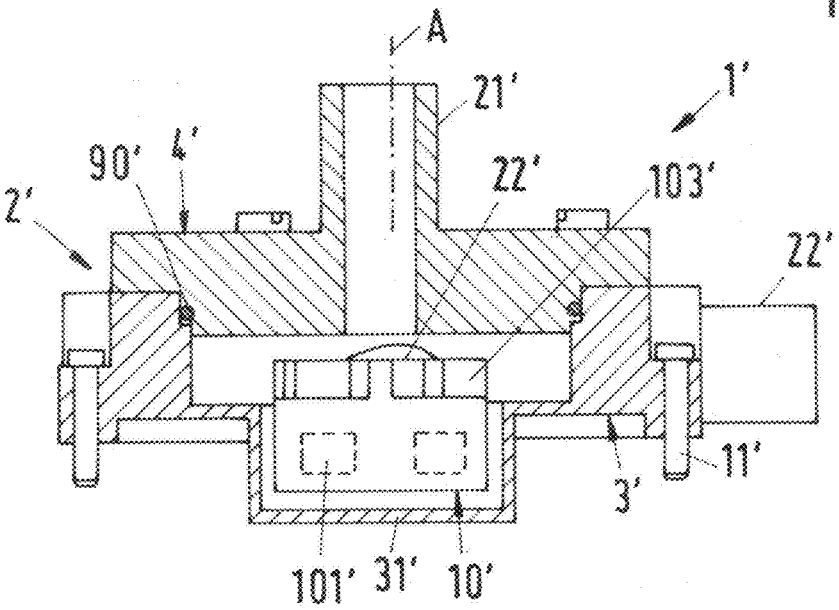
Fig.2 (Prior Art)
FIG. 2 illustrates a sectional representation of the pump unit of the centrifugal pump from FIG. 1.
Figure 3:
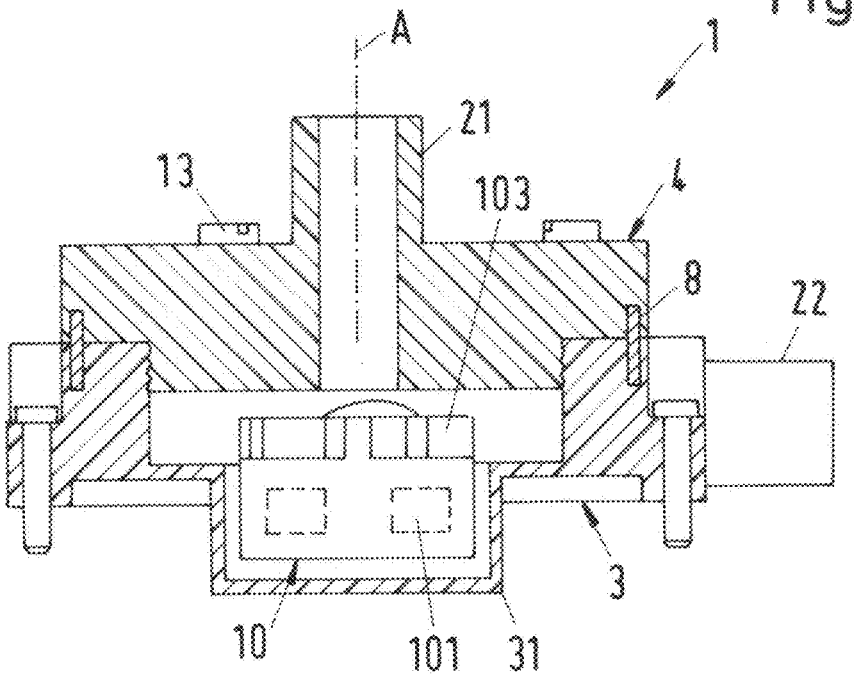
FIG. 3 illustrates a sectional representation of a first embodiment of a pump unit according to the disclosure.

In a representation analogous to FIG. 2, FIG. 3 shows a first embodiment of a pump unit according to the disclosure which is designated in its entirety by the reference sign 1. For better understanding, FIG. 4 still shows the first embodiment of the pump unit 1 in an exploded view.

The pump unit 1 is designed for a centrifugal pump 200 (see FIG. 19) for conveying a fluid and comprises a pump housing 2 with an inlet 21 and with an outlet 22 for the fluid. A rotor 10 (not represented in FIG. 4) for conveying the fluid is arranged in the pump housing 2, which forms the wheel or the impeller of the pump unit 1 and thus of the centrifugal pump 200. The rotor 10 can be rotated about a desired axis of rotation, which defines an axial direction A.

A direction perpendicular to the axial direction A is designated as the radial direction. In the following, the term "axial" is used with the generally accepted meaning "in the axial direction" or "with respect to the axial direction". The term "radial" is used with the generally accepted meaning "in the radial direction" or "with respect to the axial direction".

The pump unit 1 is designed for a contactless magnetic levitation of the rotor 10 and for a contactless magnetic drive of the rotor 10. This can be realized in particular in the analogously same way as explained on the basis of FIG. 1 and FIG. 2. Thus, the pump unit 1 according to the disclosure can be designed in the analogously same way with respect to the magnetic levitation and the magnetic drive as the pump unit 1' in FIG. 2. For this purpose, the rotor 10 of the pump unit 1 comprises a magnetically effective core 101, which is designed, for example, as a permanent magnetic ring or permanent magnetic disk and is enclosed by a plastic sheath.

Furthermore, the rotor 10 comprises a plurality of vanes 103 for conveying the fluid from the inlet 21 to the outlet 22. The vanes 103 are arranged on the plastic sheath of the magnetically effective core. The vanes 103 are preferably made of plastic and can, for example, be designed in one piece with the plastic sheath. Of course, it is also possible to manufacture the individual vanes 103 or the entirety of the vanes 103 in a separate manufacturing process and then connect them to the plastic sheath of the magnetically effective core 101, for example by a welding process.

The impeller formed by the rotor 10 with the vanes 103 is preferably designed as a radial impeller, which is approached by the fluid from the inlet 21 in axial direction A, and then deflects the fluid in a radial direction.

The pump housing 2 comprises a bottom part 3 and a cover 4 for closing the bottom part 3, wherein the bottom part 3 has a cylindrical cup 31 for receiving the rotor 10. The cup 31 is preferably designed and arranged such that it can be inserted into a recess of a drive unit 100 (FIG. 19). In particular, this can be realized in the analogously same way as explained with reference to FIG. 1. Then, the cup is arranged and designed in such a way that it can be inserted into the recess 121' (FIG. 1) in the motor housing 120' of the drive unit 100', and the magnetically effective core 101 is arranged between the transverse legs 127' of the coil cores 125'.

A substantial aspect for the operational safety of the pump unit 1 is a reliably sealing connection between the bottom part 3 and the cover 4, so that leakage of the fluid from the inside of the pump housing 2 between the bottom part 3 and the cover 4 into the external space outside the pump housing can be reliably prevented. This sealing connection must also be guaranteed at high temperatures of up to 220° C., for example, and/or at high pressures and/or for chemically very aggressive fluids, such as sulphuric acid.

According to the disclosure, for this purpose the bottom part 3 has a substantially ring-shaped first sealing surface 5 for sealing interaction with the cover 4, and the cover 4 has a substantially ring-shaped second sealing surface 6, which is designed for sealing interaction with the first sealing surface 5. For this purpose, one of the two sealing surfaces 5 or 6 is designed as a ribbed surface with at least one radial sealing rib 7, which extends in the circumferential direction along the entire sealing surface 5 or 6, while the other of the two sealing surfaces 6 or 5 is designed as a smooth surface.

Figure 4:
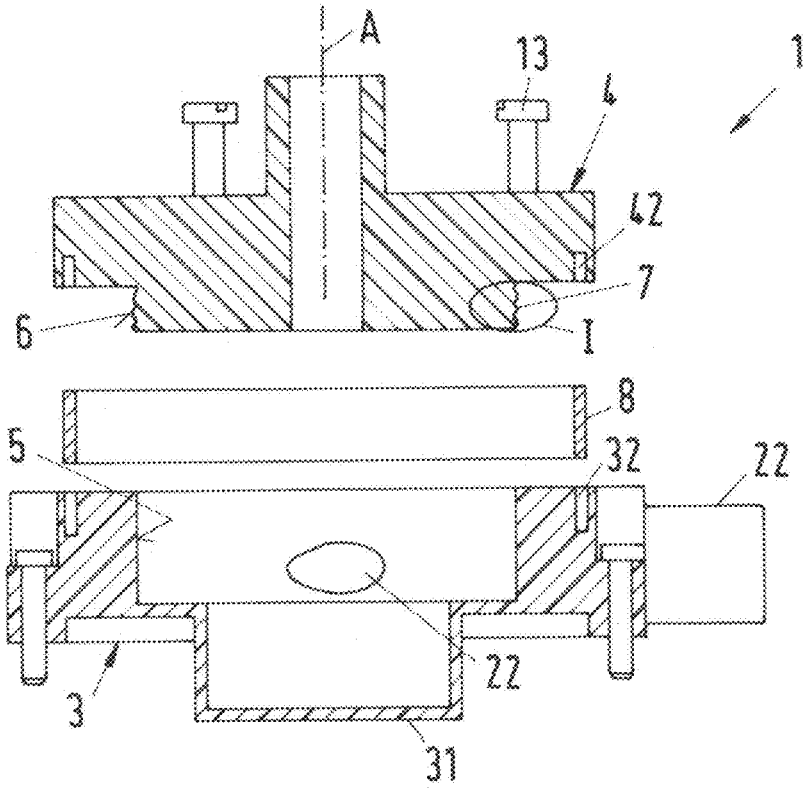
FIG. 4 illustrates as FIG. 3, but in an exploded view.

In the embodiment represented in FIG. 3 and FIG. 4, the first sealing surface 5, i.e. the sealing surface 5 of the bottom part 3, is designed as the smooth surface, and the second sealing surface 6, i.e. the sealing surface 6 of the cover 4, is designed as the ribbed surface.

Figure 5:
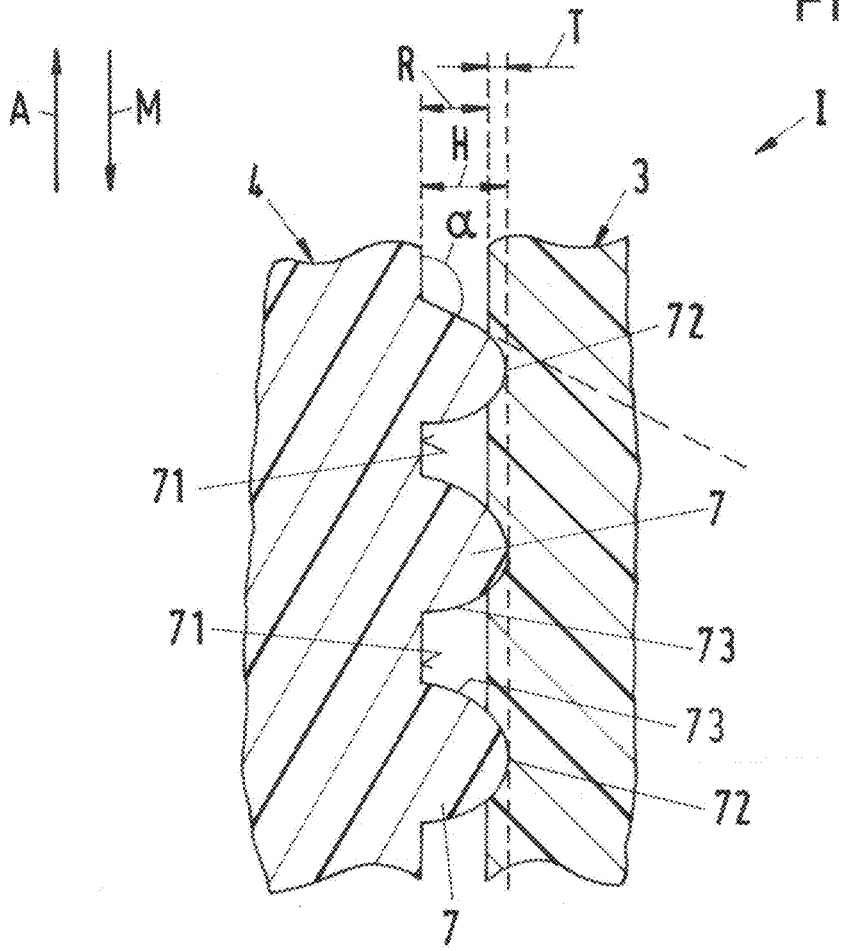
FIG. 5 illustrates the detail 1 from FIG. 4.

For better understanding, FIG. 5 still shows an enlarged representation of detail I from FIG. 4, so that the sealing interaction of the first sealing surface 5 and the second sealing surface 6 can be better recognized.

Preferably, the ribbed surface comprises several—in the first embodiment exactly three—radial sealing ribs 7, each of which extends completely along the entire ribbed surface, wherein the individual sealing ribs 7 are arranged adjacent to one another with respect to the axial direction A. Each sealing rib 7 is designed as a closed circular-shaped ring. Each radial sealing rib 7 is designed in such a way that it can absorb radial forces. For this purpose, it is preferred, but not necessary, that the sealing rib 7 is aligned perpendicularly or at right angles to the axial direction A. Embodiments are also possible in which the sealing rib 7 is arranged obliquely on the sealing surface 5 or 6, i.e. at an angle different from 90° to the axial direction A. It is only substantial that the radial sealing rib 7 has a sufficient extension in the radial direction to be able to absorb radial forces.

It is understood that the number of three sealing ribs 7 is to be understood as an example. More than three or fewer than three sealing ribs 7 can also be disposed in the sealing surface 5 or 6 designed as a ribbed surface.

Figure 15:
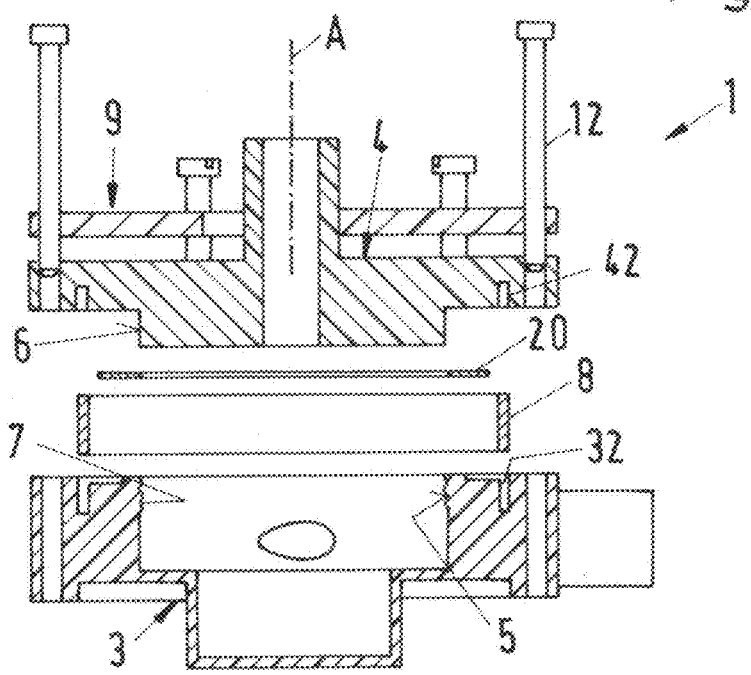
FIG. 15 illustrates a sectional representation of a fourth embodiment of a pump unit according to the disclosure in an exploded view.

Both in the first embodiment of the pump housing 1 according to the disclosure and in all other embodiments described below, variants are possible in which the first sealing surface 5 is designed as a ribbed surface and the second sealing surface 6 as a smooth surface. Both embodiments are therefore always possible in all embodiments, namely that each sealing rib 7 is disposed at the bottom part 3 and the second sealing surface at the cover 6 is designed as a smooth surface, and that each sealing rib 7 is disposed at the cover 4 and the first sealing surface 5 at the bottom part 3 is designed as a smooth surface. With an exemplary character, FIG. 15 shows an embodiment in which the sealing ribs 7 are arranged in the first sealing surface 5, i.e. in the sealing surface 5 of the bottom part 3.

The term that one of the sealing surfaces 5, 6 is designed as a "smooth surface" means that this surface has no depressions or recesses, such as grooves, in which the sealing ribs 7 could engage. Of course, it is possible that the smooth surface is plastically or elastically deformed by the sealing ribs 7 (see e.g. FIG. 5), but in the sealing surface 5 or 6 designed as a smooth surface, no texture or structure in which the sealing ribs 7 could engage is provided, i.e. in particular no grooves. The sealing effect between the sealing surface 5 or 6 designed as a ribbed surface and the sealing surface 6 or 5 designed as a smooth surface is based on the pressure of the sealing ribs 7 against the smooth surface and not on the engagement of the sealing ribs 7 in grooves or other recesses.

The pump housing 2 is preferably made of a plastic. Preferred plastics are, for example, perfluoroalkoxy polymers (PFA) or polytetrafluoroethylene (PTFE), because these have a particularly high chemical resistance and are not attacked or decomposed by chemically very aggressive substances, for example sulphuric acid. In addition, PFA and PTFE are particularly pure plastics in which no additives are used and whose molecular complexes are chemically very stable, i.e. resistant to aggressive substances.

The outlet 22 for the fluid is preferably arranged in the bottom part 3 of the pump housing 2. In particular, the outlet 22 is arranged between the cup 31 and the first sealing surface 5 with respect to the axial direction A. This means that the outlet 22 is arranged below all the sealing ribs 7 according to the representation (e.g. FIG. 3, FIG. 4), irrespective of whether the sealing ribs 7 are arranged in the second sealing surface 6 (e.g. FIG. 4) or in the first sealing surface (FIG. 15).

The sealing ribs 7 are preferably an integral part of the first or the second sealing surface 5, 6. The sealing ribs 7 can be produced in an injection molding process, for example. For example, if the cover 4 and the bottom part 3 are produced in an injection molding process, the sealing ribs 7 can be produced in the course of this injection molding by a corresponding design of the injection mold or the tool. However, it is also possible to produce the sealing ribs 7 by a subtractive machining process. The sealing ribs 7 can, for example, be machined out of the first or the second sealing surface 5, 6 by machining, e.g. milling.

The sealing interaction between the first sealing surface 5 and the second sealing surface 6 is based on a press fit between the cover 4 and the bottom part 3, which is explained in more detail on the basis of FIG. 5.

According to a preferred embodiment, the pump unit 1 further comprises a radial reinforcing element 8, which is designed in a ring-shaped manner and extends radially outwards around the two sealing surfaces 5, 6. Preferably, the radial reinforcing element 8 is designed as a metallic ring which is completely enclosed with a plastic coating. A rustproof steel or a stainless steel is preferred for the metallic ring. A highly chemically resistant plastic is preferred for the plastic coating. Examples of such preferred plastics are PTFE, PFA, ECTFE (ethylene chlorotrifluoroethylene), PP (polypropylene), ETFE (ethylene tetrafluoroethylene), PE (polyethylene). Alternatively, it is also possible to produce the radial reinforcing element 8 entirely from a strong or stable plastic.

The radial reinforcing element 8 stabilizes the two sealing surfaces 5, 6 so that they remain in better sealing contact with each other even at higher pressures in the pump housing 2. The radial reinforcing element 8 contributes to avoiding relative movements between the two sealing surfaces, which in the worst case could lead to the opening of gaps through which the fluid could escape from the pump housing 2. A further function of the radial reinforcing element 8 is to counteract creep of the bottom part 3 or the cover 4. Furthermore, the radial reinforcing element 8 can also be designed in such a way that it exerts a spring effect in a radial direction towards them, which acts on the press fit between the sealing surfaces 5, 6. In this way it is possible to adjust the press fit between the cover 4 and the bottom part 3 if the bottom part 3 or the cover 4 warps, for example.

Preferably, the radial reinforcing element 8 is arranged such that it engages both in the cover 4 and in the bottom part 3, so that the radial reinforcing element 8 engages over the boundary surface with respect to the axial direction A at which the bottom part 3 and the cover 4 rest against each other. For this purpose, a circumferential groove 42 (FIG. 4) is disposed in the cover 4, and a circumferential groove 32 is disposed in the bottom part 3, wherein the circumferential grooves 32, 42 are arranged such that they are aligned with each other, so that in the assembled state of the pump housing 2 (FIG. 3) they form a cavity for the radial reinforcing element 8, which encloses the radial reinforcing element 8.

Figure 17:
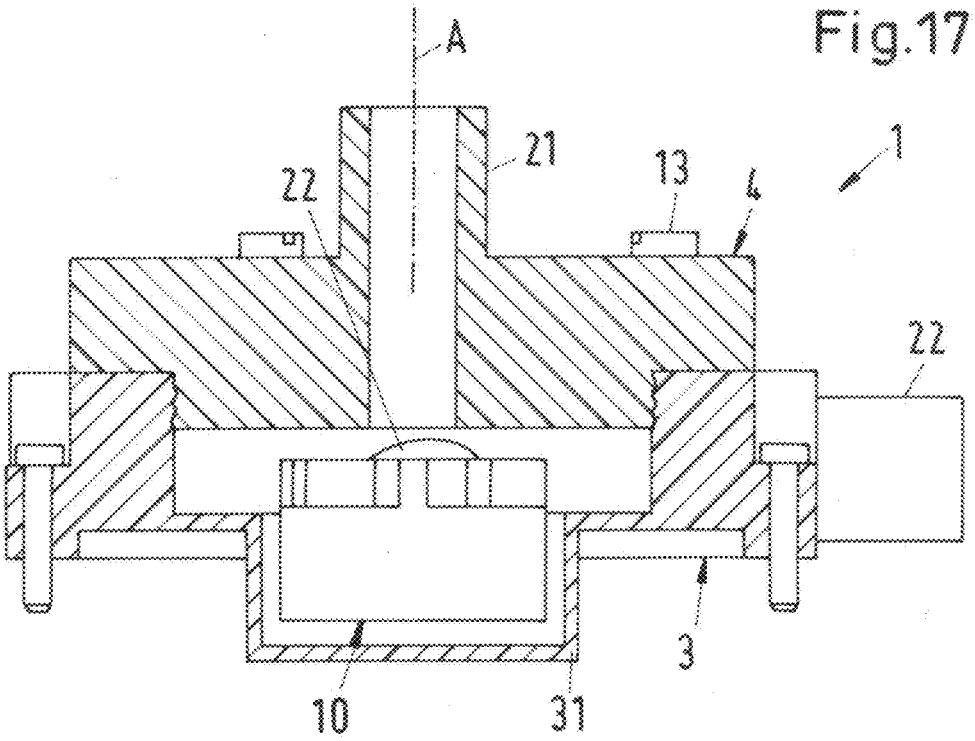
FIG. 17 illustrates a sectional representation of a sixth embodiment of a pump unit according to the disclosure.

However, embodiments without the radial reinforcing element 8 are also possible (see e.g. FIG. 17, FIG. 18).

The press fit between the cover 4 and the bottom part 3 is represented in the enlarged representation of detail 1 in FIG. 5. As already mentioned, each radial sealing rib 7 is designed in a circular ring-shaped manner, wherein the individual sealing ribs 7 are arranged adjacent to one another with respect to the axial direction A. A valley 71 is disposed between each two adjacent sealing ribs 7, wherein each valley 71 has a radial distance R from the sealing surface designed as a smooth surface-in this case the first sealing surface 5.

Each sealing rib 7 has a peak 72, which refers to that point of the sealing rib 7 that is furthest away from the adjacent valley 71 measured in the radial direction. Each sealing rib 7 has a height H, which refers to the vertical distance measured in the radial direction between the peak 72 and the adjacent valley 71. The peak 72 is connected to each of the adjacent valleys via a wall 73.

The height H of the sealing rib refers to the state when the cover 4 is not yet assembled with the bottom part 3, i.e. the state as represented in FIG. 4, for example. After the cover has been assembled with the bottom part, i.e. in the state represented in FIG. 3, for example, the sealing ribs 7 immerse into the smooth surface by an immersion depth T, for example by deformation of the first sealing surface 5, which is designed as a smooth surface. Therefore, the immersion depth T indicates the difference, measured in the radial direction, between the position of the peak 72 and the non-deformed area of the smooth surface, which is opposite one of the valleys 71.

To assemble the pump housing 2 from the bottom part 3 and the cover 4, the cover 4 is preferably brought together with the bottom part 3 in an installation direction M until the first sealing surface 5 interacts sealingly with the second sealing surface 6. This state is reached when the cover 4 rests on the bottom part 3. Here, the installation direction M is the axial direction A. After the cover 4 is connected to the bottom part 3 via the press fit, the cover 4 is fixed to the bottom part 3, for example by several fastening screws 13, which pass through the cover 4 in axial direction A and engage in the bottom part 3.

Due to the fact that the sealing ribs 7 are designed as radial sealing ribs 7 with the height H and the installation direction M is the axial direction A, the sealing ribs 7 extend transversely, for example perpendicularly, to the installation direction M. This is a more advantageous design than, for example, a sealing element that extends in the installation direction, for example an axial sealing element.

The strength of the press fit between the cover 4 and the bottom part 3 depends, inter alia, on the radial distance R, the height H and the immersion depth T, wherein the immersion depth T in particular depends on the material properties of the material or materials from which the cover 4 and the bottom part 3 are made.

In practice, it has proven that the height H is at least as great, preferably greater, than the radial distance R. The immersion depth T can—at least approximately—be zero, so that the sealing rib 7 rests against the smooth surface. However, it is preferred that the immersion depth T is greater than zero, so that the sealing rib 7 immerses in the smooth surface—in this case the first sealing surface 5. The radial distance R can—at least approximately—be zero. However, it is preferred that the radial distance R is greater than zero, i.e. the diameter of the cover 4 measured at the valley 71 is smaller than the inner diameter of the smooth surface, in this case the first sealing surface 5.

The radial distance R is preferably not smaller than zero. If the radial distance R is smaller than zero, the diameter of the cover 4 measured at the valley 71 is greater than the inner diameter of the smooth surface, in this case the first sealing surface 5. If the radial distance is smaller than zero, this has a negative effect on the separability of the cover 4 and bottom part 3. Such a separation can be necessary, for example, because the rotor 10 needs to be exchanged.

In particular for the manufacture of the cover 4 with the sealing ribs 7 (or alternatively, of course, for the manufacture of the bottom part 3 with the sealing ribs 7), it is advantageous if the connection angle $\alpha$ between the valley 71 and the wall 73 is at least 90° in each case and preferably greater than 90°, so that an undercut is avoided in each case in the transition area between the wall 73 and the valley 71. This is particularly advantageous if the sealing ribs are manufactured by an injection molding process.

With regard to the profile of the sealing ribs 7, which refers to its cross-section shown in FIG. 5 in a section in axial direction A, rounded profiles are preferred because they facilitate the joining or separation of the cover 4 and the bottom part 3. Furthermore, such profiles are preferred in which the two walls 73 of the sealing rib 7, which connect its peak 72 with the two adjacent valleys 71, are symmetrical with respect to the peak 72.

Figure 6:
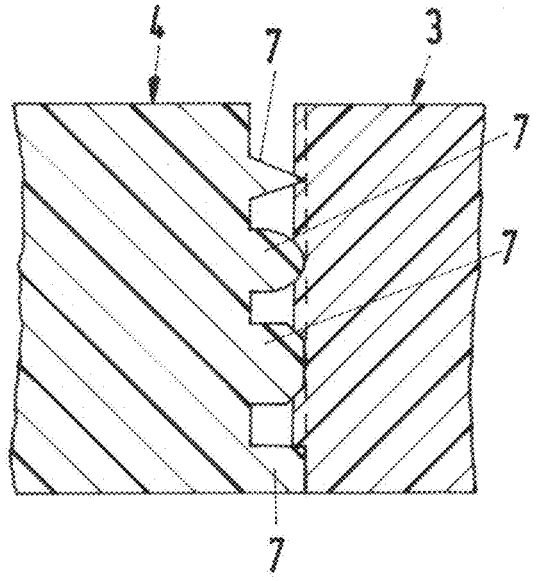
FIG. 6 illustrates a sectional representation of different variants for the sealing rib(s)

With exemplary character, FIG. 6 shows four different variants for the embodiment of the profile of the sealing ribs 7 in a section in axial direction A. The uppermost sealing rib 7 according to the representation has a substantially triangular profile. The second sealing rib 7 from the top, according to the representation, has a rectangular profile at its radially inner end, i.e. where the valleys 71 are arranged. The radially outer end of the sealing rib 7 is designed with a semicircular profile, which adjoins the rectangular profile in the radial direction. The third sealing rib 7 from the top, according to the representation, has a substantially rectangular profile, whereby the corners which face the first sealing surface 5 each include a chamfer. The lowest sealing rib, according to the representation, has a rectangular profile without a chamfer.

It is understood that countless other profiles are possible for the sealing ribs 7. Embodiments are possible in which all the sealing ribs 7 have the same profile on the sealing surface 5 or 6. Furthermore, embodiments are possible in which the sealing ribs 7 have at least two different profiles on the sealing surface 5 or 6.

Figure 7:
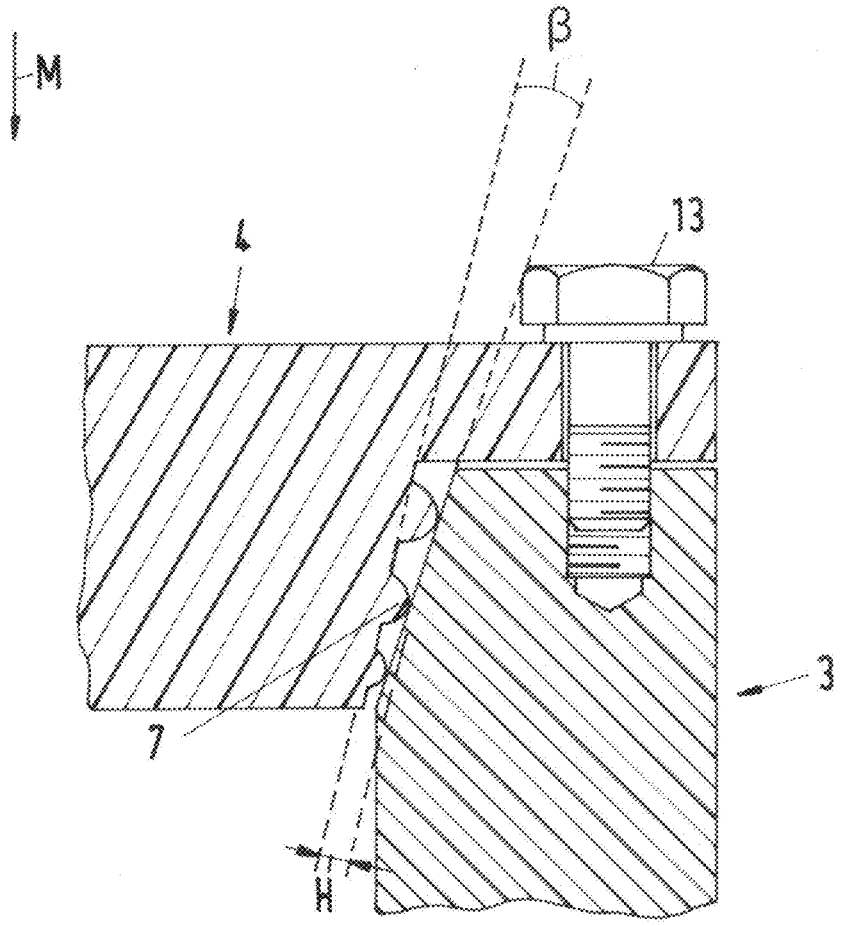
FIG. 7 illustrates a sectional representation of a variant for the sealing surfaces.

FIG. 7 shows a variant for the embodiment of the sealing surfaces 5 and 6. In this variant, the sealing surface 5 or 6 designed as a smooth surface, here with exemplary character the first sealing surface 5, is frustoconical, i.e. designed as the shell surface of a truncated cone. Therefore, the surface normal vector of the first sealing surface 5 is no longer oriented perpendicular to the axial direction, but encloses an angle different from 90° with the axial direction A. Here, the truncated cone is aligned in such a way that it tapers in the installation direction M. This means that the diameter enclosed by the sealing surface 5 perpendicular to the axial direction A decreases when viewing in the direction of the rotor 10. Thus, the first scaling surface 5 forms a kind of funnel that tapers when viewing from the cover 4 in the direction of the rotor 10.

Preferably, but not necessarily, the second sealing surface 6, which is designed here as a ribbed surface with the sealing ribs 7, is also designed in a frustoconical manner. The second sealing surface 6 is designed as the shell surface of a truncated cone, which is more acute-angled than the truncated cone whose shell surface forms the first sealing surface 5. Due to this embodiment, the first sealing surface 5 and the second sealing surface 6 enclose a gap angle $\beta$ that is different from zero. As represented in FIG. 7, the gap angle $\beta$ is the angle between the first sealing surface 5 designed as a smooth surface, and a straight line that runs through all valleys 71 of the second sealing surface 6. To ensure that the radial scaling effect is adequately maintained, the gap angle $\beta$ is at most 60° and preferably less than 30°.

It is also preferred, but not necessary, that the sealing ribs 7 have different heights H, as represented in FIG. 7. The respective height H of the sealing ribs 7 decreases the more the space enclosed by the ribbed surface—in this case the second sealing surface 6—tapers. According to the representation in FIG. 7, the uppermost scaling rib 7 has the greatest height H, and the lowest sealing rib 7, according to the representation, has the smallest height H.

It is an advantage of this conical embodiment of the scaling surfaces 5 and 6 that the press fit, i.e. in particular the strength of the press fit, can be adjusted by the fastening screws 13. The further the cone enclosed by the second sealing surface 6 is pushed into the cone enclosed by the first sealing surface 5 in the installation direction M by turning the fastening screws 13, the stronger the press fit between the cover 4 and the bottom part 3 becomes.

Furthermore, this embodiment has the advantage that the press fit can be retightened, for example in the event of long-term creep of the cover 4 and/or the bottom part 3.

In addition, the conical embodiment of the sealing surfaces 5, 6 enables easier separation of the cover 4 from the bottom part 3. The risk of damage when separating the cover 4 from the bottom part 3 against the installation direction M is significantly reduced.

Other geometries of the substantially ring-shaped sealing surfaces 5, 6 are also possible, for example the two sealing surfaces 5, 6 can be designed such that they enclose an ellipsoid or such that they enclose a spiral. The latter is preferred for such embodiments in which the pump housing 2 is designed as a volute casing.

Figure 8:
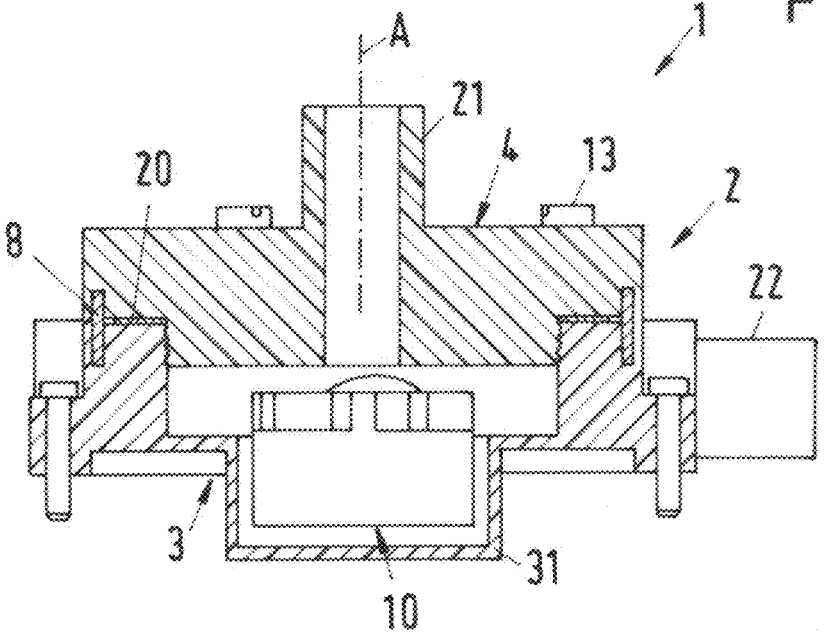
FIG. 8 illustrates a sectional representation of a variant for the first embodiment.

In a sectional representation analogous to FIG. 3, FIG. 8 shows a variant of the first embodiment of the pump unit 1 according to the disclosure. For better understanding, FIG. 9 also shows this variant in an exploded view.

Figure 9:
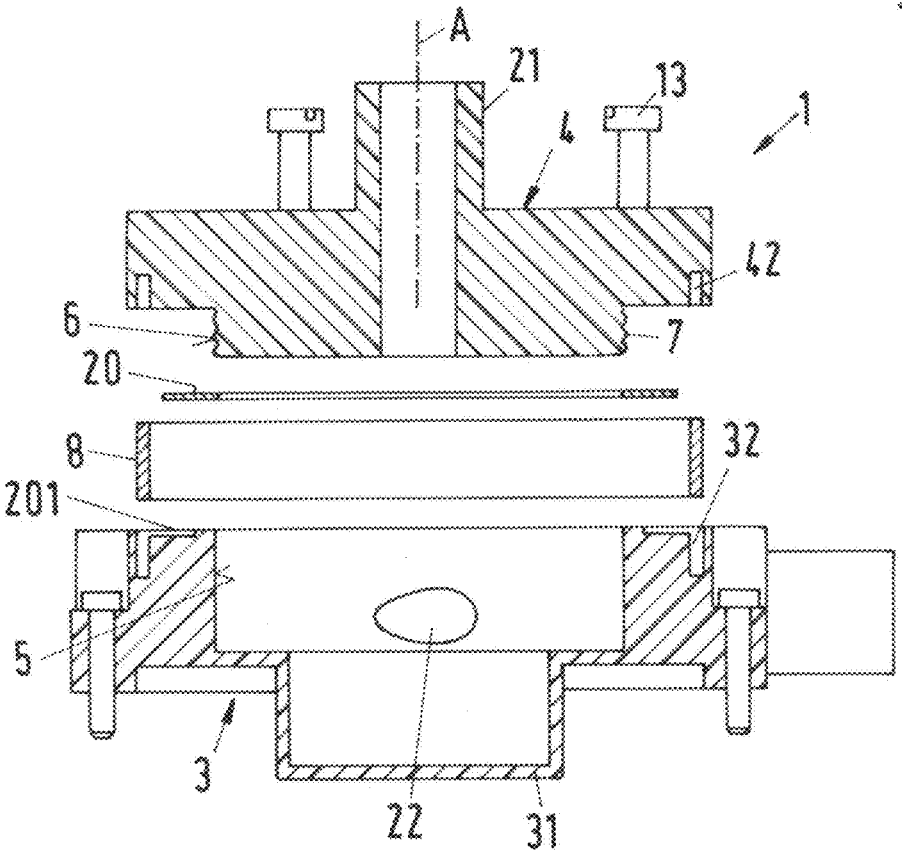
FIG. 9 illustrates as FIG. 8, but in an exploded view.

In the variant represented in FIG. 8 and FIG. 9, a ring-shaped safety seal 20 is additionally provided, which prevents an escape of the fluid between the bottom part 3 and the cover 4 in the event of a fault. With respect to the axial direction A, the safety seal 20 is arranged in the contact surface between the bottom part 3 and the cover 4. With respect to the radial direction, the safety seal 20 is arranged between the two sealing surfaces 5, 6 on the one hand and the radial reinforcing element 8, i.e. the safety seal 20 is arranged radially outwards with respect to the first sealing surface 5 and the second sealing surface 6. As a result, the safety seal 20 does not come into contact with the fluid in the trouble-free operating state of the pump unit 1. Due to the sealing interaction of the first sealing surface 5 with the second scaling surface 6, the fluid cannot penetrate as far as the safety seal 20, so that conversely there is also no risk that the fluid is contaminated by the safety seal 20.

However, should a fault occur during operation, as a result of which the sealing effect between the two sealing surfaces 5, 6 is no longer guaranteed to a sufficient extent, on the one hand the safety seal 20 prevents that the fluid escapes unintentionally or uncontrolled from the pump housing 2, so that, for example, aggressive or otherwise dangerous fluids cannot enter the environment or the exterior space of the pump housing 2. On the other hand, in such fault cases, the safety seal 20 prevents that substances enter the interior space of the pump housing from the outside, which could lead to contamination of the fluid and thus to the unusability of the fluid or the products treated with the fluid, for example wafers in the semiconductor industry.

Such faults, which can lead to an insufficient sealing effect by the two sealing surfaces 5, 6, are based, for example, on creep effects, in particular long-term creep effects, or on pressure-induced and/or temperature-induced deformations, for example of the cover 4 or the bottom part 3.

The safety seal 20 is preferably designed as a ring-shaped flat seal.

The safety seal 20 is preferably made of a plastic, for example of a plastic that is usually used for sealing at high temperatures and/or chemically aggressive fluids. For example, the safety seal 20 can be made of the same plastic as the pump housing 2. For example, the safety seal 20 can be made of PTFE. In this case, it is preferred that the safety seal 20 is made of ePTFE (expanded PTFE), in particular because ePTFE has better elastic properties than PTFE.

Of course, it is also possible to use known elastomers for the safety seal 20. Furthermore, it is possible that the safety seal is designed as a radial or axial O-ring.

Figure 10:
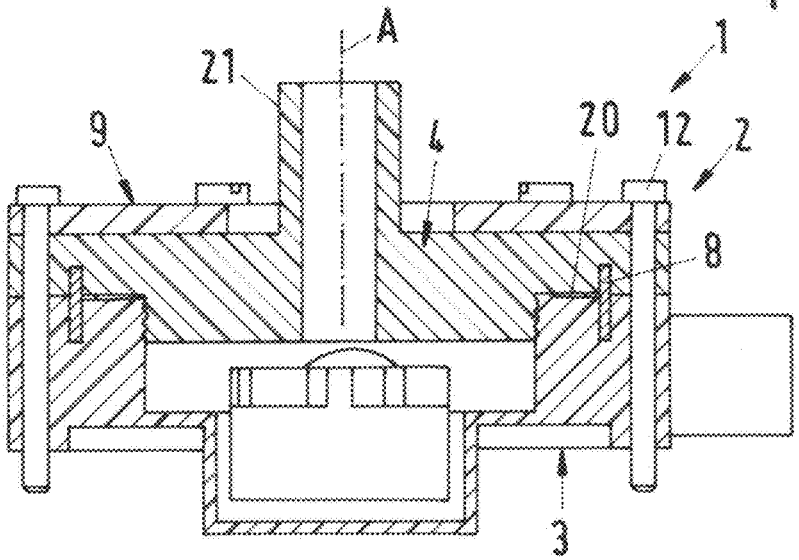
FIG. 10 illustrates a sectional representation of a second embodiment of a pump unit according to the disclosure.

In a representation analogous to FIG. 3, FIG. 10 shows a sectional representation of a second embodiment of a pump unit 1 according to the disclosure. For better understanding, FIG. 11 also shows the second embodiment in an exploded view.

In the following, only the differences from the first embodiment will be discussed. The same parts or parts equivalent in function of the second embodiment are designated with the same reference signs as in the first embodiment. In particular, the reference signs have the same meaning as already explained in connection with the first embodiment. It is understood that all previous explanations of the first embodiment and the variants also apply in the same way or in the analogously same way to the second embodiment.

In the second embodiment of the pump unit 1, an axial reinforcing element 9 is additionally disposed on the cover 4, which can absorb forces acting in axial direction A. Here, the axial reinforcing element 9 is designed as an annular disk-shaped plate, which surrounds the inlet 21 and rests on the cover 4, so that the cover 4 is arranged between the axial reinforcing element 9 and the bottom part 3.

Furthermore, a plurality of tensioning screws 12 is provided, each of which extends completely through the axial reinforcing element 9 and the pump housing 2 in the axial direction A, so that each tensioning screw 12 projects below from the pump housing 2 according to the representation with respect to the axial direction A. The tensioning screws 12 are designed to engage in the drive unit 100 (FIG. 19) when the pump unit 1 is assembled with the drive unit 100 to form the centrifugal pump 200. For this purpose, threads into which the tensioning screws 12 engage are preferably provided in the motor housing of the drive unit 100, which can, for example, be designed like the motor housing 120' in FIG. 1.

The tensioning screws 12 are arranged radially outwards with respect to the radial reinforcing element 8. By the tensioning screws 12, the pump housing 2 can be clamped between the drive unit 100 and the axial reinforcing element 9, which allows the stability of the pump housing to be significantly increased with respect to the axial direction A. Such an increased stability is particularly advantageous in applications in which very high pressures are generated with the pump unit 1, or if fluids are conveyed at very high temperatures of 200° C. or more, for example, or if the pump unit 1 is designed with very large dimensions. By the axial reinforcement element, creep caused by axial forces can be counteracted even more effectively.

As a variant, it is also possible to design the axial reinforcing element 9 with a spring effect, for example by spring washers, so that the axial reinforcing element 9 exerts a spring force, which is advantageous in order to further reduce creep of components in the axial direction A. In doing so, a readjustment of the sealing forces is also possible via which the two sealing surfaces 5, 6 interact.

Figure 11:
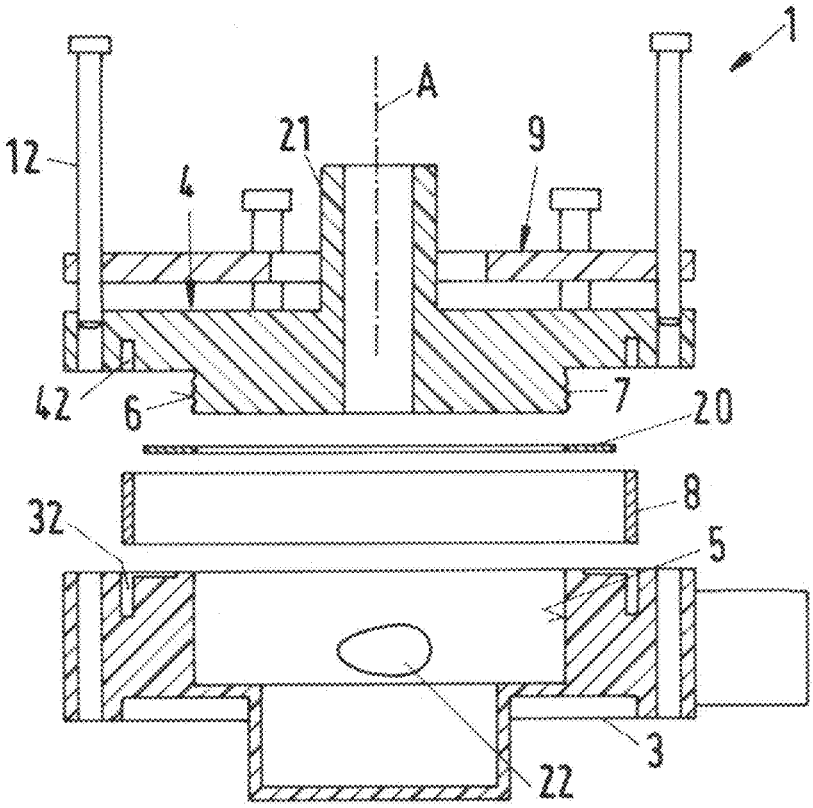
FIG. 11 illustrates as FIG. 10, but in an exploded view.

The term "axial reinforcing element 9" is to be understood to mean that the axial reinforcing element 9 can absorb axial forces. However, this does not necessarily mean that the axial reinforcing element 9 must be arranged perpendicular to the axial direction A, as shown in FIG. 10 and FIG. 11, for example. Embodiments are also possible in which the axial reinforcing element is designed obliquely to the axial direction A.

Preferably, the axial reinforcing element 9 is designed as a metallic plate that is completely enclosed by a plastic coating. A rustproof steel or a stainless steel is preferred for the metal plate. A highly chemically resistant plastic is preferred for the plastic coating. Examples of such preferred plastics are PTFE, PFA, ECTFE (ethylene chlorotrifluoroethylene), ETFE (ethylene tetrofluoroethylene), PP (polypropylene), PE (polyethylene). Alternatively, it is also possible to produce the axial reinforcing element 9 entirely from a strong or stable plastic.

Figure 12:
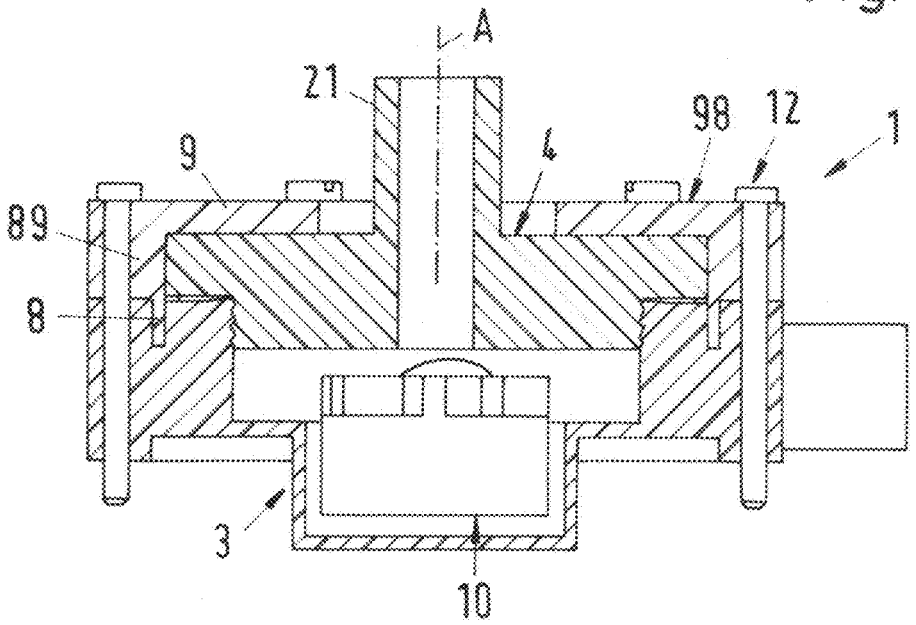
FIG. 12 illustrates a sectional representation of a variant for the second embodiment.

In a representation analogous to FIG. 10, FIG. 12 shows a sectional representation of a variant of the second embodiment of the pump unit 1 according to the disclosure. For better understanding, FIG. 13 also shows this variant in an exploded view.

Figure 13:
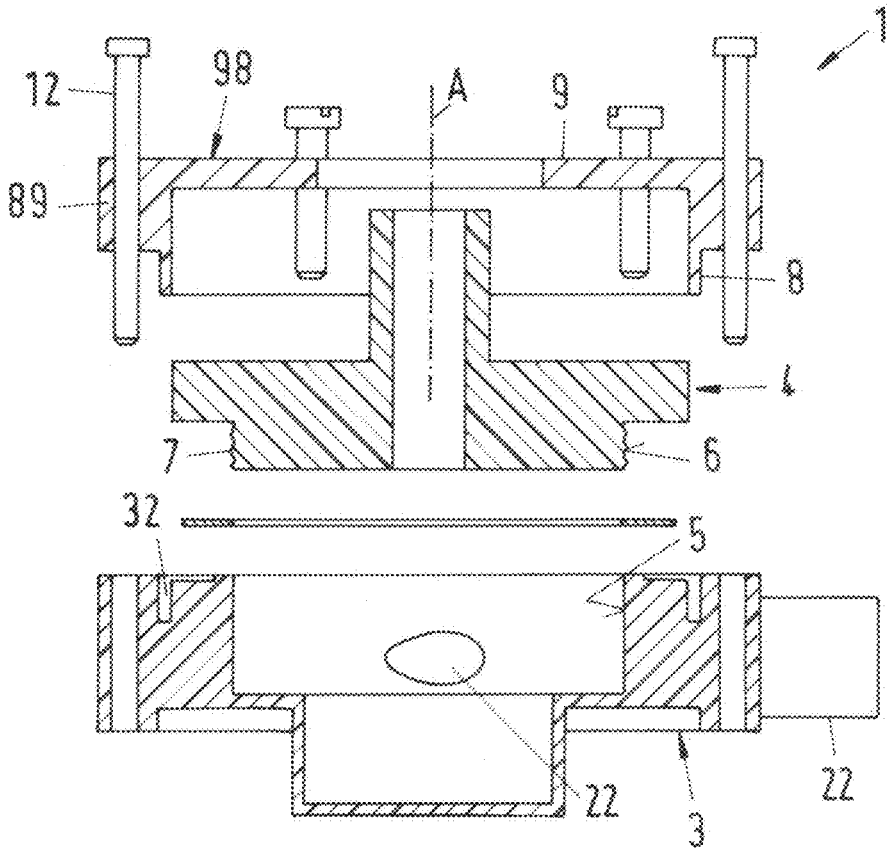
FIG. 13 illustrates as FIG. 12, but in an exploded view.

In the variant shown in FIGS. 12 and 13, the axial reinforcing element 9 is designed in one piece with the radial reinforcing element 8. Thus, a one-piece reinforcing element 98 is provided, which forms both the axial reinforcing element 9 and the radial reinforcing element 8.

The one-piece reinforcing element 98 comprises the axial reinforcing element 9, which is designed as an annular disk-shaped plate that surrounds the inlet 21 and is arranged on the cover 4, so that the cover 4 is arranged between the axial reinforcing element 9 and the bottom part 3. The one-piece reinforcing element 98 further comprises the ring-shaped reinforcing element 8, which is designed in a ring-shaped manner and extends radially outwards around the two sealing surfaces. The radial reinforcing element 8 is arranged in the circumferential groove 32 in the bottom part 3. The one-piece reinforcing element 98 further comprises a ring-shaped connecting area 89, which connects the axial reinforcing element 9 to the radial reinforcing element 8. The ring-shaped connecting area 89 adjoins the radially outer edge of the axial reinforcing element 9 and is designed such that it encloses the cover 4 radially on the outside and rests closely against the cover 4.

Preferably, the one-piece reinforcing element 98 is designed with a metallic base body that is completely enclosed by a plastic coating. A rustproof steel or a stainless steel is preferred for the metallic base body. A highly chemically resistant plastic is preferred for the plastic coating. Examples of such preferred plastics are PTFE, PFA, ECTFE (ethylene chlorotrifluoroethylene), ETFE (ethylene tetrafluoroethylene) PP (polypropylene), PE (polyethylene). Alternatively, it is also possible to produce the one-piece reinforcing element 98 entirely from a strong or stable plastic.

The one-piece embodiment of the radial reinforcing element 8 with the axial reinforcing element 9 as a one-piece reinforcing element 98 has the advantage of a particularly simple and therefore also cost-effective production. In addition, the one-piece reinforcing element 98 gives the pump unit 1 a particularly high degree of robustness, for example because the cover 4 is completely enclosed along its radially outer circumferential surface and thus supported, so that creep effects can be further reduced. This is also a particular advantage in applications in which fluids with a high temperature are conveyed.

It is understood that the variant with the one-piece reinforcing element 98 is also suitable for all other embodiments of the pump unit 1 according to the disclosure.

Figure 14:
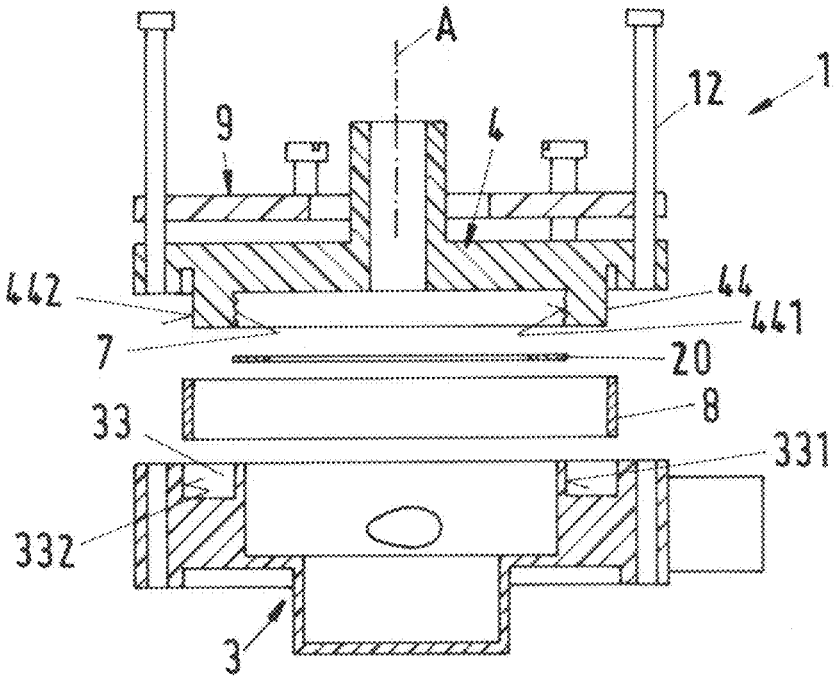
FIG. 14 illustrates a sectional representation of a third embodiment of a pump unit according to the disclosure in an exploded view.

In an exploded view analogous to FIG. 11, FIG. 14 shows a sectional representation of a third embodiment of a pump unit 1 according to the disclosure.

In the following, only the differences to the previously described embodiments will be discussed. The same parts or parts equivalent in function of the third embodiment are designated with the same reference signs as in the previously described embodiments. In particular, the reference signs have the same meaning as already explained in connection with the previously described embodiments. It is understood that all previous explanations with regard to the embodiments and variants also apply in the same way or in the analogously same way to the third embodiment.

The third embodiment of the pump unit 1 according to the disclosure is similar in design to the second embodiment (FIG. 11). However, in the third embodiment, the circumferential groove 32 in the bottom part of the second embodiment is replaced by a ring-shaped groove 33, which is significantly wider than the circumferential groove 32 of the second embodiment with respect to its width measured in the radial direction.

The ring-shaped groove 33 is limited with respect to the radial direction by a radial inner wall 331 and a radial outer wall 332, wherein the radial outer wall 332 is arranged radially outwardly with respect to the radial inner wall 331. Thus, the width of the ring-shaped groove 33 is the radial distance between the radial inner wall 331 and the radial outer wall 332. The radial inner wall 331 forms the first sealing surface 5 of the bottom part 3, wherein the first sealing surface 5 is designed here as the smooth sealing surface.

The cover 4 of the third embodiment is designed with a ring-shaped axial end region 44, which engages in the ring-shaped groove 33. The ring-shaped axial end region 44 is limited with respect to the radial direction by a radial inner surface 441 and by a radial outer surface 442, wherein the radial outer surface 442 is arranged radially outwardly with respect to the radial inner surface 441. The radial inner surface 441 of the axial end region 44 forms the second sealing surface 6 of the cover 4, which is designed here as the ribbed surface with the sealing ribs 7.

When the axial end region 44 of the cover 4 is brought into engagement with the ring-shaped groove 33 of the bottom part, the first sealing surface 5 formed by the radial inner wall 331 and the second sealing surface 6 formed by the radial inner surface 441 interact in a sealing manner.

The width of the ring-shaped groove 33 is dimensioned such that the ring-shaped radial reinforcing element 8 can engage into the ring-shaped groove 33, so that the radial reinforcing element 8 is arranged between the axial end region 44 and the radial outer wall 332 with respect to the radial direction.

The radial extensions of the ring-shaped groove 33, the axial end region 44 and the radial reinforcing element 8 are dimensioned in such a way that a press fit is realized between the cover 4 and the bottom part 3 and the first sealing surface 5 interacts sealingly with the second sealing surface 6.

According to a variant of the third embodiment of the pump unit 1, which is not represented in the drawing, the first sealing surface 5, i.e. the sealing surface 5 of the bottom part 3, is designed as the ribbed surface with the sealing ribs 7, and the second sealing surface 6, i.e. the sealing surface 6 of the cover 4, is designed as the smooth surface. Thus, in this variant, the radial inner wall 331 of the ring-shaped groove 33 is designed as the ribbed surface and the radial inner surface 441 of the axial end region 44 is designed as the smooth surface.

In an exploded view analogous to FIG. 11, FIG. 15 shows a sectional representation of a fourth embodiment of a pump unit 1 according to the disclosure.

In the following, only the differences to the previously described embodiments will be discussed. The same parts or parts equivalent in function of the fourth embodiment are designated with the same reference signs as in the previously described embodiments. In particular, the reference signs have the same meaning as already explained in connection with the previously described embodiments. It is understood that all previous explanations with regard to the embodiments and variants also apply in the same way or in the analogously same way to the fourth embodiment.

As already mentioned above, both embodiments are possible for the pump housing 1 according to the disclosure—and this also applies in particular to all embodiments described here—in which the first sealing surface 5 of the bottom part 3 is designed as a smooth surface and the second sealing surface 6 of the cover 4 is designed as a ribbed surface with the sealing ribs 7, and embodiments in which the first sealing surface 5 of the bottom part 3 is designed as a ribbed surface with the sealing ribs 7, and the second sealing surface 6 of the cover 4 is designed as a smooth surface.

With an exemplary character, the fourth embodiment of the pump unit 1 according to the disclosure shows an embodiment in which the first sealing surface 5 is designed as a ribbed surface. The fourth embodiment is designed similarly to the second embodiment (FIG. 11). However, in the fourth embodiment, the first sealing surface 5, i.e. the sealing surface of the bottom part 3, is designed as a ribbed surface with the sealing ribs 7. The second sealing surface 6, i.e. the sealing surface of the cover 4, is designed as a smooth surface.

Figure 16:
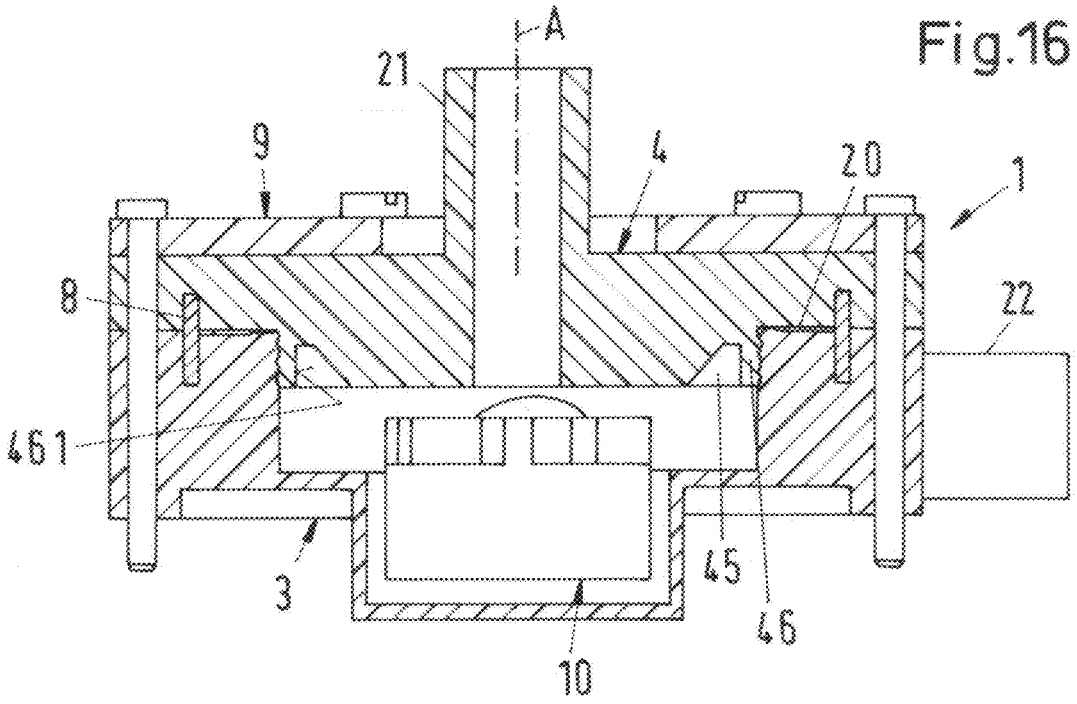
FIG. 16 illustrates a sectional representation of a fifth embodiment of a pump unit according to the disclosure in an exploded view.

In a sectional representation analogous to FIG. 10, FIG. 16 shows a fifth embodiment of a pump unit 1 according to the disclosure.

In the following, only the differences to the previously described embodiments will be discussed. The same parts or parts equivalent in function of the fifth embodiment are designated with the same reference signs as in the previously described embodiments. In particular, the reference signs have the same meaning as already explained in connection with the previously described embodiments. It is understood that all previous explanations with regard to the embodiments and variants also apply in the same way or in the analogously same way to the fifth embodiment.

The fifth embodiment (FIG. 16) of the pump unit 1 according to the disclosure is designed similarly to the second embodiment (FIG. 10).

In the fifth embodiment, a ring-shaped recess 45 is disposed in the cover 4, which extends radially inwards and adjacent to the second sealing surface 6, wherein the ring-shaped recess 45 is separated from the second sealing surface 6 on its radially outer side by a ring-shaped web 46. The radially inner boundary surface 461 of the web 46 forms the radially outer boundary of the recess 45. The radially outer boundary surface of the web 46 forms the second sealing surface 6, i.e. the sealing surface 6 of the cover 4, which is designed here as the ribbed surface with the sealing ribs 7. Thus, the ring-shaped recess 45 is arranged at the same height with respect to the axial direction A as the sealing surfaces 5 and 6. In the operating state of the pump unit 1, the ring-shaped recess 45 is of course also filled with the fluid, so that the pressure of the fluid exerts a radially outwardly directed force on the web 46, which reinforces the sealing interaction of the first sealing surface 5 and the second sealing surface 6.

In all the previously described embodiments and variants, the outlet of the pump housing is disposed in the bottom part 3. In particular, the outlet 22 is always arranged below the sealing ribs 7 according to the representation, i.e. with respect to the axial direction A, the outlet 22 is arranged between the cylindrical cup 31 and the two sealing surfaces 5 and 6. This is also the preferred embodiment, i.e. that all sealing ribs 7 are arranged above (according to the representation in FIGS. 3, 4, 8-16) the outlet 22. However, such embodiments are also possible in which the separating surface between the cover 4 and the bottom part 3 is arranged significantly closer to the cylindrical cup 31 with respect to the axial direction A, so that the outlet 22 is located above the sealing ribs 7 according to the representation. For example, the outlet 22 can be arranged in the cover 4.

In a sectional representation analogous to FIG. 3, FIG. 17 shows a sixth embodiment of a pump unit 1 according to the disclosure. For better understanding, FIG. 18 still shows the sixth embodiment of the pump unit 1 in an exploded view.

In the following, only the differences to the previously described embodiments will be discussed. The same parts or parts equivalent in function of the fifth embodiment are designated with the same reference signs as in the previously described embodiments. In particular, the reference signs have the same meaning as already explained in connection with the previously described embodiments. It is understood that all previous explanations with regard to the embodiments and variants also apply in the same way or in the analogously same way to the fifth embodiment.

The sixth embodiment of the pump unit 1 according to the disclosure is designed similarly to the first embodiment (FIG. 3, FIG. 4). In contrast to the first embodiment, no radial reinforcing element 8 is provided in the sixth embodiment. Therefore, the circumferential grooves 32, 42 (FIG. 4) provided in the first embodiment are also not present in the sixth embodiment.

Furthermore, the centrifugal pump 200 for conveying a fluid with a pump unit 1 is proposed by the disclosure, wherein the pump unit 1 is designed according to the disclosure. In a schematic sectional representation, FIG. 19 shows an embodiment of a centrifugal pump 200 according to the disclosure. The centrifugal pump 200 comprises the drive unit 100, which comprises a motor housing. For reasons of a better overview, the motor housing is not shown in FIG. 19. However, the drive unit 100 can, for example, be designed in the analogous same way as the drive unit 100' with the motor housing 120' represented in FIG. 1, wherein the recess 121' is disposed in the motor housing 120', into which recess the cylindrical cup 31 of the bottom part 3 of the pump housing 1 is inserted.

A stator 102 is arranged in the motor housing, which forms an electromagnetic rotary drive with the rotor 10 for rotating the rotor 10 about the axial direction A, wherein the drive unit 100 is designed for contactless magnetic levitation of the rotor 10.

Preferably, the stator 102 is designed as a bearing and drive stator, with which the rotor 10 can be magnetically driven without contact and can be magnetically levitated without contact with respect to the stator 102, wherein the rotor is passively magnetically stabilized with respect to the axial direction A and is actively magnetically levitated, i.e. controllably, in the radial plane E perpendicular to the axial direction.

Particularly preferably, the electromagnetic rotary drive with the rotor 10 and the stator 102 is designed as a temple motor, wherein the stator 102 has a plurality of coil cores 125, each of which comprises a longitudinal leg 126, which extends from a first end in the axial direction A to a second end, and a transverse leg 127, which is arranged at the second end of the longitudinal leg 126 and in the radial plane E. The transverse leg 127 extends from the longitudinal leg 126 in radial direction inwards towards the rotor 10.

All first ends of the longitudinal legs 126—i.e. the lower ends according to the representation—are connected to each other by a back iron 122 for conducting the magnetic flux.

The coil cores 125 are arranged around the rotor 10 with respect to the circumferential direction, so that the rotor 10 is arranged between the transverse legs 127 of the coil cores 125. At least one concentrated winding 160 is provided at each longitudinal leg 126, which surrounds the respective longitudinal leg 126.

The electromagnetic rotating fields required for the magnetic drive and the magnetic levitation of the rotor 10 are generated with the concentrated windings 160. With these concentrated windings 160, those electromagnetic rotating fields are thus generated in the operating state with which a torque is effected on the rotor 10 in a manner known per se, and with which an arbitrarily adjustable transverse force can be exerted on the rotor 10 in the radial direction, so that the radial position of the rotor 10, i.e. its position in the radial plane E perpendicular to the axial direction A, can be actively controlled or regulated. With respect to three further degrees of freedom, namely its position in the axial direction and tilting with respect to the radial plane E perpendicular to the desired axis of rotation (two degrees of freedom), the rotor 10 is passively magnetically levitated or stabilized by reluctance forces, i.e. it cannot be controlled.

What is claimed is:

1. A pump unit for a centrifugal pump for conveying a fluid, comprising:

a pump housing including an inlet and an outlet for the fluid; and a rotor arranged in the pump housing to convey the fluid, the rotor configured to be rotated about an axial direction, the pump unit being configured to contactless magnetic levitate the rotor and contactless magnetic drive the rotor, the pump housing having a bottom part and a cover to close the bottom part, the bottom part having a cylindrical cup to receive the rotor and a substantially ring-shaped first sealing surface to configured to cause sealing interaction with the cover, and the cover having a substantially ring-shaped second sealing surface configured to cause sealing interaction with the first sealing surface, one of the first and second sealing surfaces being a ribbed surface with at least one radial sealing rib extending in a circumferential direction along the entirety of the one of the first and second sealing surfaces, and an other of the first and second sealing surfaces is a smooth surface, the at least one radial sealing rib configured to prevent fluid from escaping between the cover and the bottom part.

2. The pump unit according to claim 1, further comprising a radial reinforcing element, radial reinforcing element configured in a ring-shaped manner and extending radially outwards around the first and second sealing surfaces.

3. The pump unit according to claim 1, wherein the ribbed surface comprises a plurality of radial sealing ribs, each radial sealing rib of the plurality of radial sealing ribs extending in the circumferential direction along an entirety of the ribbed surface, the plurality of radial sealing ribs are arranged adjacent to one another with respect to the axial direction, and a valley is disposed between two adjacent sealing ribs of the plurality of sealing ribs, the valley has a radial distance different from zero from the smooth surface, and each radial sealing rib of the plurality of radial sealing ribs has a height measured in a radial direction which is greater than the radial distance of the valley from the smooth surface.

4. The pump unit according to claim 2, wherein the radial reinforcing element engages both in the cover and in the bottom part.

5. The pump unit according to claim 1, wherein the smooth surface is frustoconical-shaped.

6. The pump unit according to claim 2, wherein a ring-shaped safety seal is arranged with respect to a radial direction, the ring-shaped safety seal being disposed between the first and second sealing surfaces and the radial reinforcing element, the ring-shaped safety seal configured to prevent an escape of the fluid between the bottom part and the cover in the event of a fault.

7. The pump unit according to claim 1, wherein an axial reinforcing element is provided on the cover to absorb forces acting in the axial direction, the axial reinforcing element being arranged such that the cover is located between the axial reinforcing element and the bottom part with respect to the axial direction.

8. The pump unit according to claim 6, wherein the axial reinforcing element is formed in one piece with a radial reinforcing element.

9. The pump unit according to claim 1, wherein the bottom part comprises a ring-shaped groove which is delimited by a radial inner wall and by a radial outer wall, the cover is configured to seal engagement into the groove, and the radial inner wall or the radial outer wall forms the first sealing surface.

10. The pump unit according to claim 1, wherein a ring-shaped recess is disposed in the cover, the ring-shaped recess extends radially inwards and adjacent to the second sealing surface, and the ring-shaped recess is separated from the second sealing surface by a ring-shaped web, so that in an operating state the pressure of the fluid on the ring-shaped web reinforces a sealing interaction of the first sealing surface and the second sealing surface.

11. The pump unit according to claim 1, wherein the first sealing surface is the smooth sealing surface, and the second sealing surface is the ribbed surface.

12. A pump unit for a centrifugal pump for conveying a fluid, comprising:

a pump housing including an inlet and an outlet for the fluid;

a rotor arranged in the pump housing to convey the fluid, the rotor configured to be rotated about an axial direction, the pump unit being configured to contactless magnetic levitate the rotor and contactless magnetic drive the rotor, the pump housing having a bottom part and a cover to close the bottom part, the bottom part having a cylindrical cup to receive the rotor and a substantially ring-shaped first sealing surface to configured to cause sealing interaction with the cover, and the cover having a substantially ring-shaped second sealing surface configured to cause sealing interaction with the first sealing surface, one of the first and second sealing surfaces being a ribbed surface with at least one radial sealing rib extending in a circumferential direction along the entirety of the one of the first and second sealing surfaces, and an other of the first and second sealing surfaces is a smooth surface; and a radial reinforcing element configured in a ring-shaped manner and extending radially outwards around the first and second sealing surface, and the radial reinforcing element being a metallic ring encapsulated with a coating of a plastic material.

13. A centrifugal pump for conveying the fluid, comprising:

a pump unit according to claim 1; and a drive unit comprising a motor housing in which a stator is arranged which, together with the rotor, forms an electromagnetic rotary drive to rotate the rotor about the axial direction, the drive unit configured for the contactless magnetic levitation of the rotor.

14. The centrifugal pump according to claim 13, wherein the stator is a bearing and drive stator, with which the rotor is capable of being magnetically driven without contact and magnetically levitated without contact with respect to the stator, the rotor passively magnetically stabilized with respect to the axial direction and actively magnetically levitated in a radial plane perpendicular to the axial direction, and the motor housing has a recess in an axial end face into which the cylindrical cup of the pump housing can be inserted.

15. The centrifugal pump according to claim 14, wherein the electromagnetic rotary drive is a temple motor, the stator has a plurality of coil cores, each coil core of the plurality of coil cores comprising a longitudinal leg extending from a first end in the axial direction to a second end, and a transverse leg arranged at the second end of the longitudinal leg and in the radial plane, and extending from the longitudinal leg in a radial direction, the plurality of coil cores are arranged around the rotor with respect to the circumferential direction, so that the rotor is arranged between the transverse legs of the plurality of coil cores, and at least one concentrated winding is provided at each longitudinal leg, the at least one concentrated winding surrounding a respective longitudinal leg.

16. The pump unit according to claim 6, wherein an axial reinforcing element is provided on the cover to absorb forces acting in the axial direction, the axial reinforcing element being arranged such that the cover is located between the axial reinforcing element and the bottom part with respect to the axial direction.

17. The pump unit according to claim 16, wherein the axial reinforcing element is formed in one piece with the radial reinforcing element.

* * * * *